US010866555B2

(12) United States Patent
Okuma et al.

(10) Patent No.: US 10,866,555 B2
(45) Date of Patent: Dec. 15, 2020

(54) IMAGE FORMING APPARATUS CAPABLE OF DETECTING SHEET

(71) Applicant: CANON KABUSHIKI KAISHA, Tokyo (JP)

(72) Inventors: Yasuhiko Okuma, Abiko (JP); Keisuke Nakano, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 15/855,384

(22) Filed: Dec. 27, 2017

(65) Prior Publication Data

US 2018/0203402 A1 Jul. 19, 2018

(30) Foreign Application Priority Data

Jan. 19, 2017 (JP) ..... 2017-007885
Jul. 21, 2017 (JP) ..... 2017-142001
Dec. 1, 2017 (JP) ..... 2017-231929

(51) Int. Cl.
*G03G 15/00* (2006.01)
*G03G 21/20* (2006.01)
*G03G 15/20* (2006.01)

(52) U.S. Cl.
CPC ..... *G03G 15/70* (2013.01); *G03G 15/5029* (2013.01); *G03G 15/55* (2013.01); *G03G 15/2039* (2013.01); *G03G 21/206* (2013.01); *G03G 2215/00721* (2013.01)

(58) Field of Classification Search
CPC .... G03G 15/70; G03G 15/5029; G03G 15/55; G03G 15/2039; G03G 21/206; G03G 2215/00721
See application file for complete search history.

(56) References Cited

U.S. PATENT DOCUMENTS 3,695,758 A * 10/1972 Tanaka ..... G03F 9/70 355/71
5,430,915 A * 7/1995 Ueda ..... D06F 67/04 26/51
2007/0019981 A1* 1/2007 Kawamata ..... G03G 15/6573 399/92

(Continued)

FOREIGN PATENT DOCUMENTS

JP 04-015433 B2 3/1992
JP 2008-111923 A 5/2008

(Continued)

OTHER PUBLICATIONS

Machine Translation of JP-2008111922 (Year: 2008).*

*Primary Examiner* — David H Banh
(74) *Attorney, Agent, or Firm* — Venable LLP

(57) ABSTRACT

An emitter emits light such that the light crosses a conveyance path. A reflector reflects the light. A receiver receives reflected light. A determiner determines that a sheet is present on the basis of an amount of reflected light. A controller may increase a light amount of the light-emitting unit from a first light amount to a second light amount on the basis of a temperature of the light-emitting unit and a reflectance of the reflecting member. The controller may increase a receiving gain of the receiver from a first gain to a second gain on the basis of a reflectance of the reflecting member.

31 Claims, 17 Drawing Sheets

(56) References Cited

U.S. PATENT DOCUMENTS

| | | | | |
|---|---|---|---|---|
| 2007/0286656 | A1* | 12/2007 | Ito | G03G 15/70 399/389 |
| 2008/0197924 | A1* | 8/2008 | Oishi | H03F 1/08 330/144 |
| 2009/0250863 | A1* | 10/2009 | Hirate | B65H 5/062 271/4.1 |
| 2010/0079740 | A1* | 4/2010 | Takahashi | G03B 27/72 355/71 |
| 2011/0002704 | A1* | 1/2011 | Fujita | G03G 15/0131 399/74 |
| 2011/0243585 | A1* | 10/2011 | Mizutani | G03G 15/0856 399/35 |
| 2013/0336667 | A1* | 12/2013 | Watanabe | G03G 15/6555 399/23 |
| 2015/0097035 | A1* | 4/2015 | Duan | G06K 7/10831 235/462.21 |
| 2017/0302260 | A1* | 10/2017 | Iwamizu | H03K 17/0822 |

FOREIGN PATENT DOCUMENTS

| | | | | |
|---|---|---|---|---|
| JP | 2008111922 | A | * | 5/2008 |
| JP | 2015-125433 | A | | 7/2015 |
| JP | 2016-060596 | A | | 4/2016 |

* cited by examiner

IMAGE FORMING APPARATUS CAPABLE OF DETECTING SHEET

BACKGROUND OF THE INVENTION

Field of the Invention

The present invention relates to an image forming apparatus capable of detecting a sheet.

Description of the Related Art

A fixing apparatus fixes a toner image onto a sheet by applying heat and pressure to the toner image. A sheet sensor is employed to detect jams in sheets arising within or near the fixing apparatus. There are two types of sheet sensors. The first type is a sheet sensor that detects a sheet by pivoting when pressed by the sheet. The second type is a sheet sensor that detects a sheet when light is shielded by the sheet (Japanese Patent Publication No. 4-15433). The latter has no mechanical operations, and thus sheets can be detected accurately even when there is little distance between the leading and following sheets.

In conventional sheet sensors, light emitted by a light-emitting unit is reflected by a reflecting member and the reflected light is received by a light-receiving unit. As such, if the reflectance of the reflecting member decreases, the accuracy of detecting the sheet will decrease as well. For example, with a sheet sensor arranged within or near a fixing apparatus, vapor emitted from the sheet sometimes sticks to and condenses on the reflecting member, causing a decrease in the reflectance.

SUMMARY OF THE INVENTION

Accordingly, the invention makes it possible to accurately detect a sheet even in environments where condensation can arise.

The present invention provides an image forming apparatus comprising: a light-emitting unit that emits light such that the light crosses a conveyance path along which a sheet is conveyed; a reflecting member, provided opposite the light-emitting unit, that reflects the light; a light-receiving unit that receives reflected light from the reflecting member; a cooling unit that cools the light-emitting unit by supplying air to the light-emitting unit; a determination unit that determines whether or not the sheet is present on the basis of an amount of reflected light received by the light-receiving unit; and a light amount control unit that increases a light amount of the light-emitting unit from a first light amount to a second light amount on the basis of a temperature of the light-emitting unit cooled by the cooling unit and a reflectance of the reflecting member.

The present invention further provides an image forming apparatus comprising: a light-emitting unit that emits light such that the light crosses a conveyance path along which a sheet is conveyed; a reflecting member, provided opposite the light-emitting unit, that reflects the light; a light-receiving unit that receives reflected light from the reflecting member; a determination unit that determines whether or not the sheet is present on the basis of an amount of reflected light received by the light-receiving unit; and a gain control unit that increases a receiving gain of the light-receiving unit from a first gain to a second gain on the basis of a reflectance of the reflecting member.

Further features of the invention will become apparent from the following description of exemplary embodiments (with reference to the attached drawings).

DESCRIPTION OF THE EMBODIMENTS

First Embodiment

An electrophotographic color laser printer will be described as an example of an image forming apparatus with reference to the drawings. Note that the scope of the invention is not intended to be limited to the dimensions, materials, shapes, relative arrangements, and so on of the constituent elements described in this embodiment unless otherwise explicitly specified. Additionally, the image forming apparatus according to the invention is not intended to be limited only to a color laser printer, and may be another image forming apparatus such as a photocopier or a facsimile device.

Image Forming Apparatus

Figure 1:
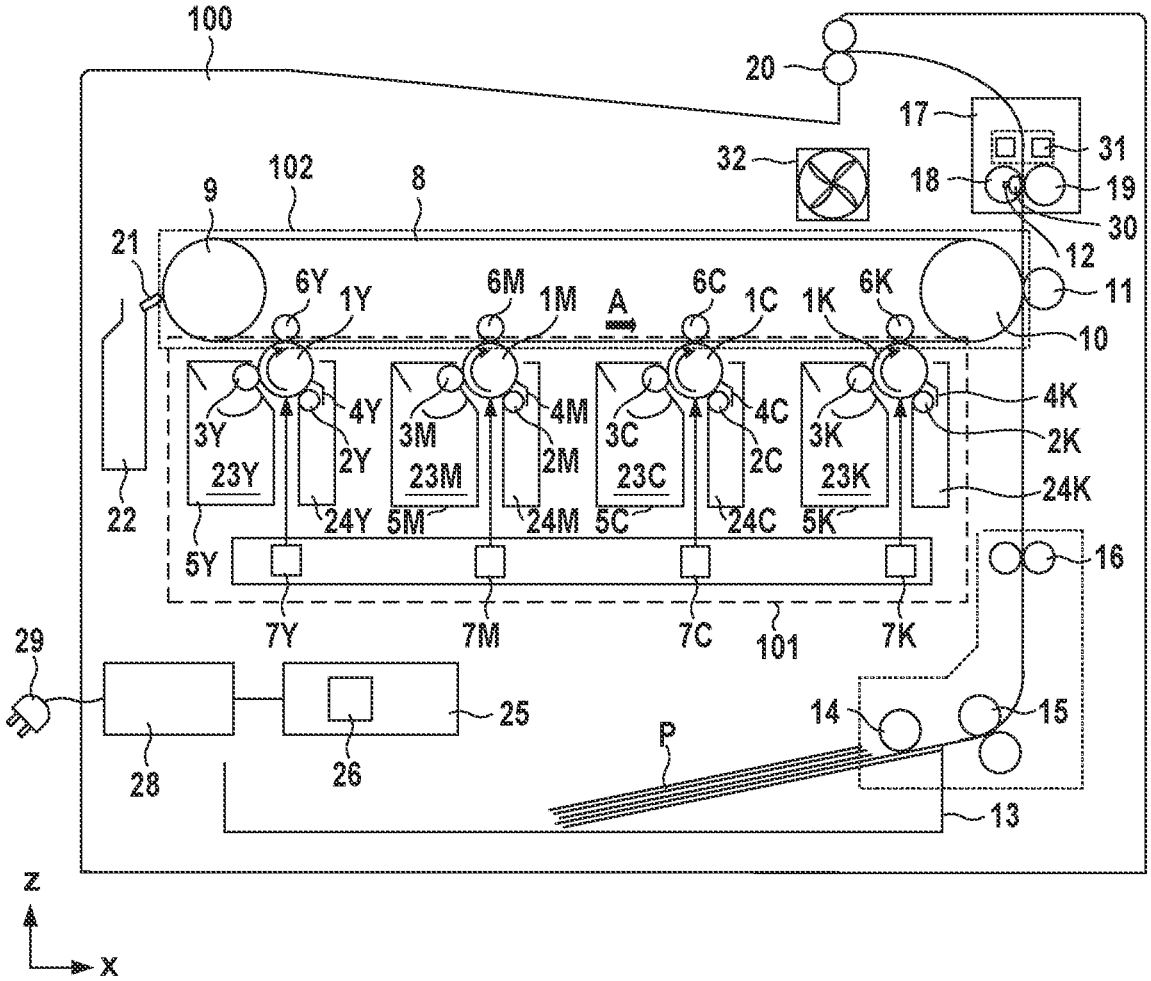
FIG. 1 is an overall cross-sectional view of an image forming apparatus.

An image forming apparatus 100 illustrated in FIG. 1 includes process cartridges 5Y, 5M, 5C, and 5K that can be removed from the main unit. Note that the letters Y, M, C, and K appended to the reference signs indicate yellow, magenta, cyan, and black toner colors, respectively, and will be omitted in descriptions of items that are the same for all colors. Each process cartridge 5 includes a toner receptacle 23, a photosensitive drum 1, a charging roller 2, a developing roller 3, a cleaning member 4, and a waste toner receptacle 24. The process cartridges 5 form an image forming section 101 with exposure devices 7.

The toner receptacle 23 holds a developing agent (denoted as "toner" hereinafter). The photosensitive drum 1 is an image carrier that holds an electrostatic latent image, a toner image, or the like. The charging roller 2 uniformly charges the surface of the photosensitive drum 1. The exposure device 7 outputs a laser beam on the basis of image information and forms an electrostatic latent image on the surface of the photosensitive drum 1. The developing roller 3 forms a toner image by causing toner supplied from the toner receptacle 23 to adhere to the electrostatic latent image and then developing the toner.

An intermediate transfer unit 102, which is an example of a transfer unit, includes an intermediate transfer belt 8, a driving roller 9, an opposing roller 10, and a primary transfer roller 6. The primary transfer roller 6 is arranged opposite the photosensitive drum 1, and makes a primary transfer of the toner image held on the photosensitive drum 1 onto the intermediate transfer belt 8. The intermediate transfer belt 8 is tensioned between the driving roller 9 and the opposing roller 10, and is rotationally driven by the driving roller 9. The intermediate transfer belt 8 rotates in the direction indicated by the arrow A, and conveys the toner image to a secondary transfer section. The secondary transfer section is formed by the intermediate transfer belt 8 and a secondary transfer roller 11.

A paper feed cassette 13 holds a plurality of sheets P. The sheet P is a recording medium (recording material) constituted by a material whose surface reflects or absorbs light rather than transmitting light, such as paper. A paper feed roller 14 picks up and feeds the sheet P to a conveyance path. Conveyance rollers 15 take the sheet P passed from the paper feed roller 14 and convey that sheet P further downstream in a conveyance direction. Registration rollers 16 are conveyance rollers that synchronize the timing at which the sheet P arrives at the secondary transfer section with the timing at which the toner image arrives at the secondary transfer section. The toner image is transferred onto the sheet P in the secondary transfer section. A belt cleaner 21 removes toner remaining on the intermediate transfer belt 8 and collects the removed toner into a waste toner receptacle 22.

The sheet P onto which the toner image has been transferred is then conveyed to a fixing apparatus 17. The fixing apparatus 17 includes a heating roller 18 and a pressure roller 19 that apply heat and pressure to the toner image on the sheet P. A heating unit such as a heater 30 is provided within the heating roller 18. Additionally, the heater 30 is provided with a temperature sensor 12 that measures the temperature of the heating roller 18 or the heater 30. A discharge roller 20 discharges the sheet P onto which the toner image has been fixed to the exterior of the image forming apparatus 100.

A sheet sensor 31 is provided downstream from the heating roller 18 and the pressure roller 19, within the fixing apparatus 17. "Downstream" refers to being downstream in the conveyance direction of the sheet P. The sheet sensor 31 is a reflective-type optical sensor. The sheet sensor 31 detects the sheet P conveyed by the heating roller 18 and the pressure roller 19.

A cooling unit 32 includes a fan that blows or sucks air, and a motor that drives the fan. The cooling unit 32 is provided outside the fixing apparatus 17. The cooling unit 32 cools the sheet sensor 31 by, for example, delivering air via a ventilation duct within the fixing apparatus 17. By cooling a light-emitting unit 33, a greater driving current can be applied, which makes it possible to increase the amount of light emitted.

A control board 25 has an electric circuit that controls the various elements in the image forming apparatus 100. For example, a CPU 26 that controls the various elements of the image forming apparatus 100 by executing a control program is mounted on the control board 25. The CPU 26 may handle control pertaining to a drive source (not illustrated) for conveying the sheet P, control pertaining to the sheet sensor 31, control of the cooling unit 32, control of drive sources (not illustrated) of the process cartridges 5, control pertaining to image formation, control pertaining to the detection of malfunctions, and so on. A switching-mode power supply 28 transforms an AC power source voltage input from a power source cable 29 connected to an external power source into a DC voltage and supplies the DC voltage to the control board 25 and the like.

Sheet Sensor

Figure 2A:
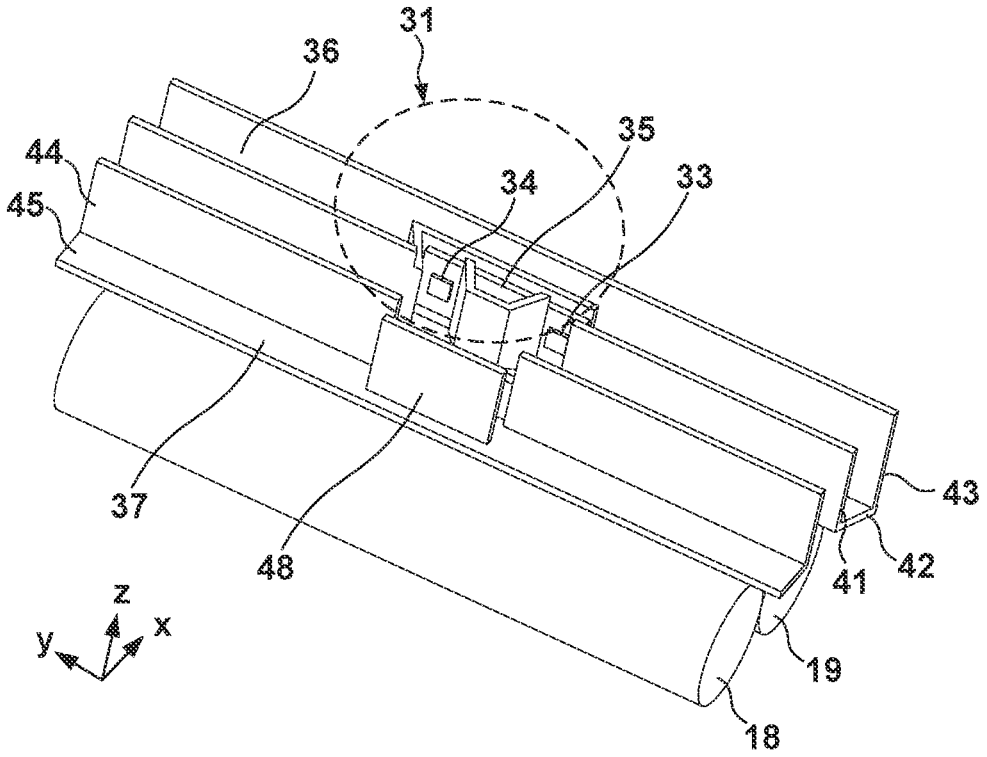
FIGS. 2A and 2B are perspective views of a sheet sensor.
Figure 2B:
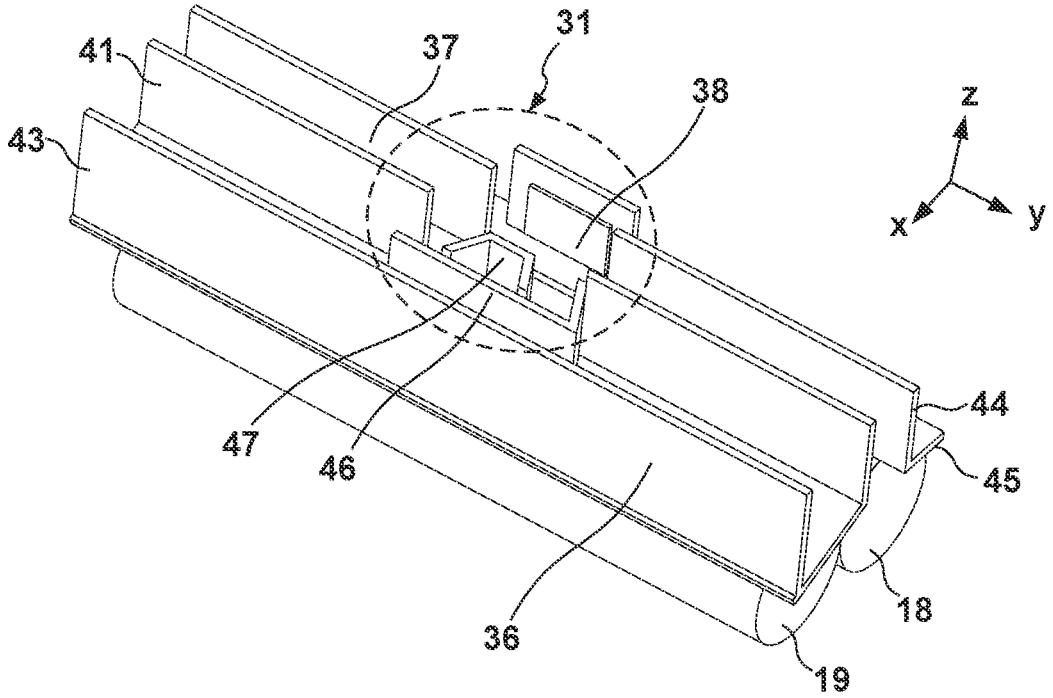

FIGS. 2A and 2B are perspective views of the sheet sensor 31. FIGS. 2A and 2B illustrate the sheet sensor 31 from different viewpoints. Note that arrows x, y, and z, which indicate directions, have been added in order to facilitate understanding of the orientation of the sheet sensor 31. The arrow z indicates a height direction of the image forming apparatus 100, which is parallel to the conveyance direction of the sheet P in the fixing apparatus 17.

A first guide 36 is a guide member, arranged above the pressure roller 19, that guides the sheet P. A cross-section of the first guide 36 parallel to a zx plane has a substantially U shape. In other words, one end portion of a first member 41 is connected to one end portion of a second member 42. Additionally, another end portion of the second member 42 is connected to one end portion of a third member 43. The first member 41 has a guide face that guides the sheet P.

A second guide 37 is a guide member, provided above the heating roller 18 and opposite the first guide 36, that guides the sheet P. A cross-section of the second guide 37 parallel to the zx plane has a substantially L shape. In other words, one end portion of a fourth member 44 is connected to one end portion of a fifth member 45. The fourth member 44 has a guide face that guides the sheet P, and is parallel to the first member 41.

A cutout is provided in the center of the first member 41 of the first guide 36. A board 35 is fixed to a board holding member 46 projecting upward from the second member 42. The light-emitting unit 33 and a light-receiving unit 34 are mounted on the board 35. A light shielding member 47 projecting upward from the second member 42 is provided between the light-emitting unit 33 and the light-receiving unit 34.

A cutout is provided in the center of the fourth member 44 of the second guide 37 as well. A reflecting member 38 is fixed to a reflecting member holding portion 48 projecting upward from the fifth member 45. In this example, the reflecting member holding portion 48 and the board holding member 46 are parallel. The light-emitting unit 33, the reflecting member 38, and the light-receiving unit 34 are positioned such that light emitted from the light-emitting unit 33 is reflected by the reflecting member 38 through specular reflection and the reflected light is incident on the light-receiving unit 34. The reflecting member 38 may have a member or a reflective film having light-reflective properties. For example, a mirror, a glossy metal or resin, or the like can be employed as the reflecting member 38.

Figure 3A:
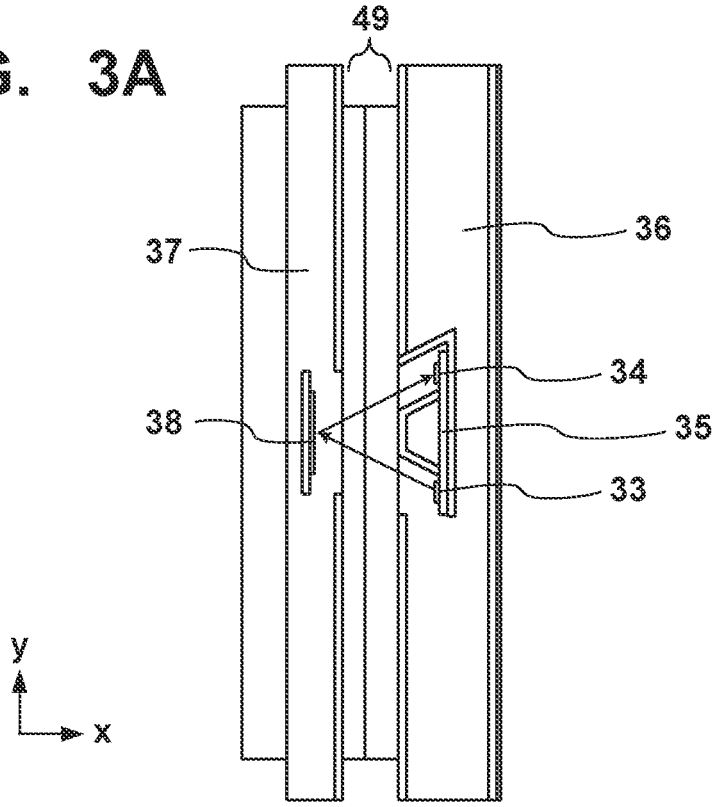
FIGS. 3A and 3B are plan views of the sheet sensor.
Figure 3B:
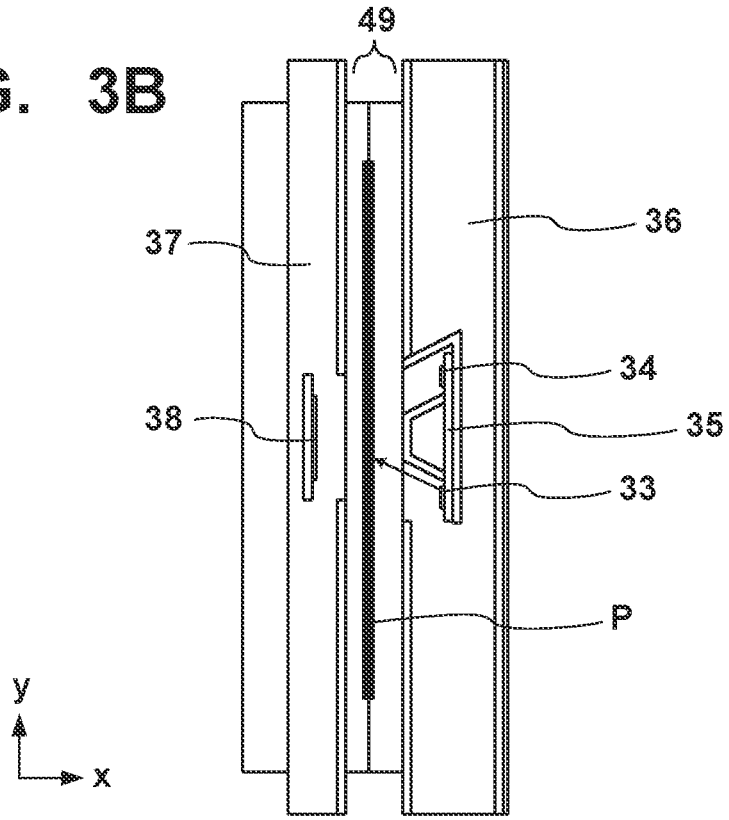

FIG. 3A is a plan view of the sheet sensor 31 when the sheet P is not passing therethrough. FIG. 3B is a plan view of the sheet sensor 31 when the sheet P is passing therethrough. As illustrated in FIG. 3A, the light emitted by the light-emitting unit 33 crosses a conveyance path 49 and reaches the reflecting member 38 of the second guide 37. The emitted light is reflected by the surface of the reflecting member 38, crosses the conveyance path 49, and reaches the light-receiving unit 34. As a result, the light-receiving unit 34 outputs a detection signal indicating that the sheet P is not detected (example: a low-level signal). Alternatively, the light-receiving unit 34 does not output a detection signal indicating that the sheet P is detected (example: a high-level signal).

While the sheet P is being conveyed along the conveyance path 49, the light from the light-emitting unit 33 reaches the surface of the sheet P but is shielded by the surface of the sheet P, as illustrated in FIG. 3B. In other words, light does not reach the reflecting member 38, and the light-receiving unit 34 also cannot receive the reflected light from the reflecting member 38. As a result, the light-receiving unit 34 outputs a detection signal indicating that the sheet P is detected (example: a high-level signal). Alternatively, the light-receiving unit 34 does not output a detection signal indicating that the sheet P is detected (example: a low-level signal).

Cooling Unit

Figure 4:
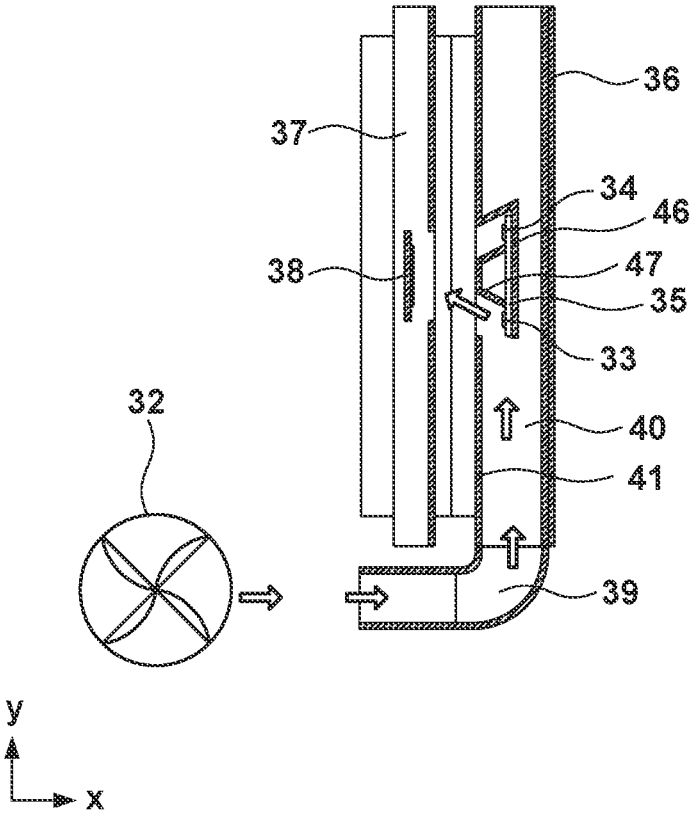
FIG. 4 is a cross-sectional view illustrating a ventilation duct for the sheet sensor.

FIG. 4 is a cross-sectional view of a cooling mechanism of the sheet sensor 31. The arrows in FIG. 4 indicate the flow of air. An exhaust guide 39 guides air blown from the cooling unit 32 to the first guide 36. The exhaust guide 39 and the first guide 36 form a ventilation duct 40. As illustrated in FIG. 4, the board 35 is disposed within the ventilation duct 40. Additionally, a gap for allowing air that has entered from the exhaust guide 39 to pass is provided between the first member 41 of the first guide 36 and the light-emitting unit 33. The light-emitting unit 33 is cooled by the air passing through this gap. Furthermore, the air that has passed through this gap is guided to the reflecting member 38 by a wall constituting part of the light shielding member 47, which has a trapezoidal cross-section. Having air blown onto the reflecting member 38 makes it difficult for paper debris and the like to adhere to the reflective surface of the reflecting member 38. Additionally, blowing low-humidity air disperses vapor near the reflecting member 38, which makes it easy to reduce condensation. In this manner, the light-emitting unit 33 can be cooled by guiding air from the cooling unit 32 disposed outside the fixing apparatus 17 to the light-emitting unit 33, and the reflecting member 38 can furthermore be cleaned by the air that is blown thereon.

Note that the board 35 may be interposed between the board holding member 46 and the light shielding member 47. This makes it possible to stably position the board 35. Furthermore, in addition to also functioning as an air guide member, the light shielding member 47 can also function as a member that holds the board 35.

Description of Circuitry

Figure 5A:
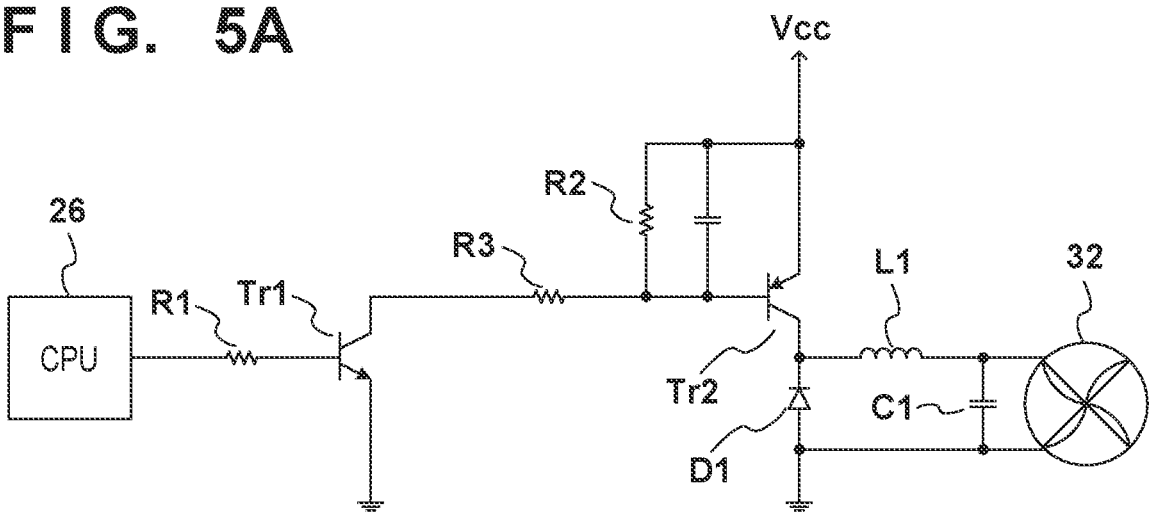
FIGS. 5A to 5C are diagrams illustrating a driving circuit of a cooling unit and a driving circuit of the sheet sensor.

FIG. 5A illustrates the driving circuit of the cooling unit 32. This driving circuit is a step-down converter. The CPU 26 outputs a driving signal (PWM signal) for driving the cooling unit 32. The PWM signal is inputted to the base of a transistor Tr1 via a limiting resistor R1. The transistor Tr1 turns on when the PWM signal goes to high level. When the transistor Tr1 turns on, a reference voltage Vcc is divided by resistors R2 and R3; the resulting voltage is applied to the base of a transistor Tr2, which turns the transistor Tr2 on. When the transistor Tr2 turns on, a charge current flows from the reference voltage Vcc to an electrolytic capacitor C1 via the transistor Tr2 and a coil L1. When the PWM signal goes to low level, the transistor Tr1 turns off, and the transistor Tr2 also turns off as a result. As a result, current flows along a route constituted by the coil L1, the electrolytic capacitor C1, and a regenerative diode D1. By repeating the on/off of the PWM signal, a voltage based on the on duty of the PWM signal is generated at both ends of the electrolytic capacitor C1. This voltage is a lower voltage than the reference voltage Vcc. This voltage is applied to the motor of the cooling unit 32, and the motor rotates as a result. A rotation rate of the motor is decided in accordance with the voltage applied to the motor.

The CPU 26 changes the voltage supplied to the cooling unit 32 by changing the on duty of the PWM signal. For example, by outputting a PWM signal having a first duty, the CPU 26 sets the airflow rate of the cooling unit 32 to a first airflow rate. Likewise, by outputting a PWM signal having a second duty, the CPU 26 sets the airflow rate of the cooling unit 32 to a second airflow rate. If the second duty is greater than the first duty, the second airflow rate will be greater than the first airflow rate.

Figure 5B:
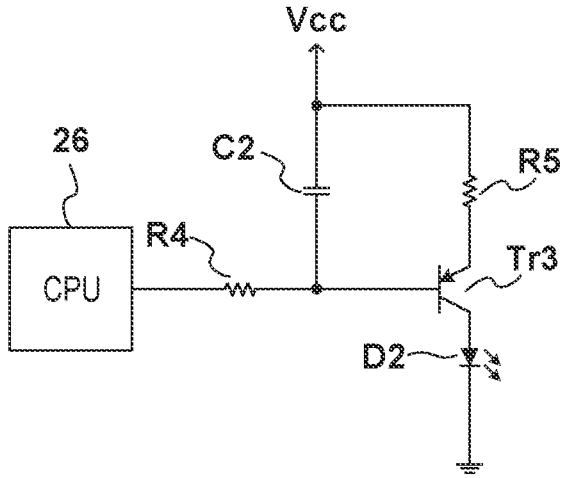

FIG. 5B illustrates the driving circuit of the light-emitting unit 33. The CPU 26 outputs a PWM signal for driving the light-emitting unit 33. The PWM signal is smoothed by a smoothing circuit constituted by a resistor R4 and a capacitor C2, and is then input to the base of a transistor Tr3. This turns the transistor Tr3 on. A limiting resistor R5 that limits current is provided between the collector of the transistor Tr3 and the reference voltage Vcc. A light-emitting diode D2 constitutes the light-emitting unit 33. The CPU 26 switches the amount of light emitted by the light-emitting unit 33 by changing the duty of the PWM signal. For example, by outputting a PWM signal having a first duty, the CPU 26 sets the amount of light emitted by the light-emitting unit 33 to a first light amount. Likewise, by outputting a PWM signal having a second duty, the CPU 26 sets the amount of light emitted by the light-emitting unit 33 to a second light amount. If the second duty is greater than the first duty, the second light amount will be greater than the first light amount. Note that the light-emitting unit 33 can be switched on/off by switching the driving signal on/off.

Condensation and Light Intensity Control

When condensation forms on the reflecting member 38, the reflectance thereof drops, the amount of light received by the light-receiving unit 34 decreases, and accuracy of detecting the sheet P drops. Taking into consideration the decrease in the amount of light received, it is conceivable to set the light-emitting unit 33 to constantly emit a greater amount of light. Doing so makes it possible to receive enough light to detect the sheet P, even if condensation has formed or paper debris has adhered to the reflecting member 38. However, the rated current of the light-emitting diode D2 drops as the ambient temperature of the light-emitting unit 33 rises. Thus as the ambient temperature rises, it becomes difficult to sufficiently increase the amount of light emitted by the light-emitting diode D2, which also causes a drop in the amount of light received. The light-emitting diode D2 will also degrade more quickly as the light emission amount increases, the light emission time increases, and so on. Accordingly, the CPU 26 may use a lower light emission amount until the amount of light received drops due to condensation on the reflecting member 38, and may then increase the light emission amount when the amount of light received drops.

Figure 6A:
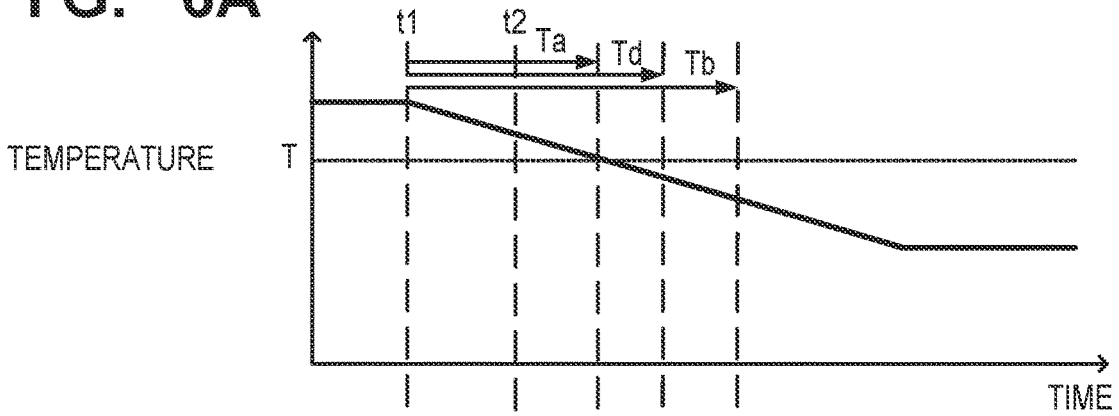
FIGS. 6A to 6D are diagrams illustrating relationships between the temperature of a light-emitting unit or a reflecting member and reflectance.
Figure 6B:
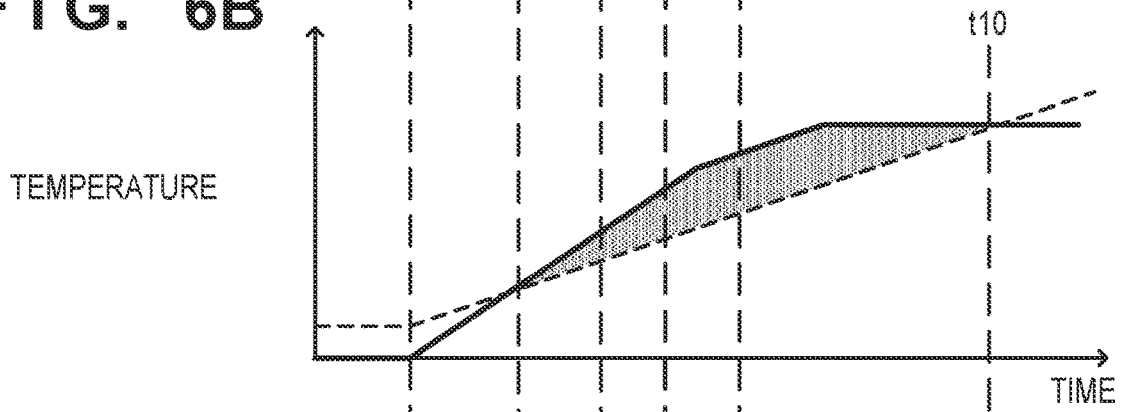

FIG. 6A illustrates changes in the temperature of the light-emitting unit 33. The horizontal axis represents elapsed time. The vertical axis represents temperature. FIG. 6B indicates changes in the temperature of the reflecting member 38 (the broken line) and a dew point temperature (the solid line). Note that the hatched region between the broken line in the solid line indicates a condensation amount. FIG.

6C indicates changes in the reflectance of the reflecting member 38. FIG. 6D indicates changes in a setting value of the light amount in this embodiment.

At time t1, the CPU 26 starts the formation of an image and starts the cooling operations of the cooling unit 32. The temperature of the light-emitting unit 33 begins to drop as a result. The temperature of the light-emitting unit 33 is T when an amount of time Ta has elapsed from time t1. The temperature T is a temperature at which the CPU 26 can switch the amount of light emitted by the light-emitting unit 33 from low level to high level. In other words, an increase in the amount of light is limited when the temperature of the light-emitting unit 33 is greater than or equal to T in order to suppress degradation of the light-emitting unit 33.

As indicated by the broken line in FIG. 6B, the reflecting member 38 is exposed to radiant heat from the heat source of the fixing apparatus 17, and thus the temperature of the reflecting member 38 rises. As indicated by the solid line in FIG. 6B, the dew point temperature in the periphery of the reflecting member 38 increases as the image forming time lengthens. This is because as the ambient temperature of the reflecting member 38 rises, moisture in the sheet P is vaporized by the fixing apparatus 17, and the amount of vapor in the periphery of the reflecting member 38 increases as a result. As indicated in FIG. 6B, condensation forms on the reflecting member 38 when the dew point temperature exceeds the temperature of the reflecting member 38 at time t2.

Figure 6C:
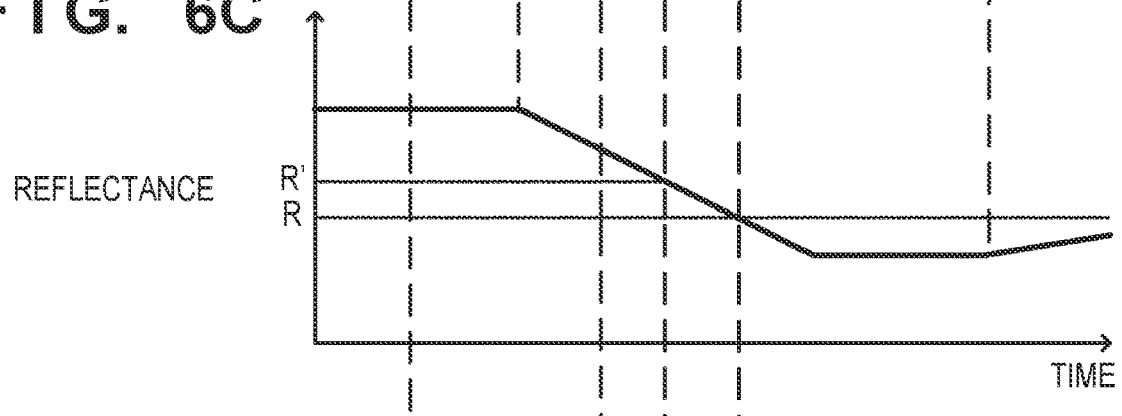
Figure 6D:
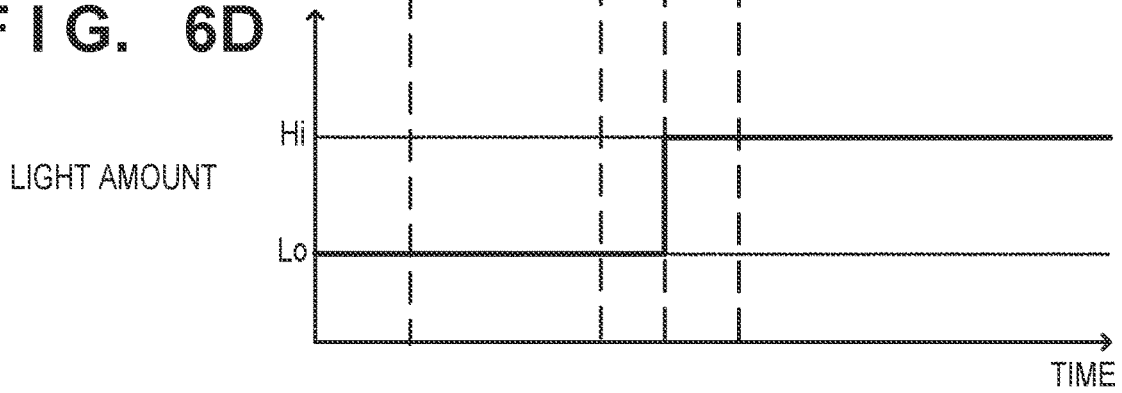

As indicated in FIG. 6C, the condensation forming on the reflecting member 38 causes a drop in the reflectance of the reflecting member 38. The amount of reflected light incident on the light-receiving unit 34 drops as the reflectance of the reflecting member 38 drops. When the amount of received light drops below an amount of light necessary to detect whether or not a sheet P is present, a sheet P will mistakenly be detected as being present even when there is no sheet P. As indicated in FIG. 6C, a lower-limit reflectance at which erroneous detections arise in the case where the light emission amount of the light-emitting unit 33 is low level is indicated as a limit reflectance R. The timing at which the reflectance becomes the limit reflectance R corresponds to an amount of time Tb passing from time t1. The reflectance drops below the limit reflectance R upon the amount of time Tb elapsing. The relationship between the amount of time Ta and the amount of time Tb is Ta<Tb.

Accordingly, as illustrated in FIG. 6D, the CPU 26 switches the light emission amount of the light-emitting unit 33 from low level to high level upon an amount of time Td passing from time t1. The amount of light received becomes greater than or equal to the necessary amount as a result, which improves the accuracy of detecting the sheet P.

Figure 7:
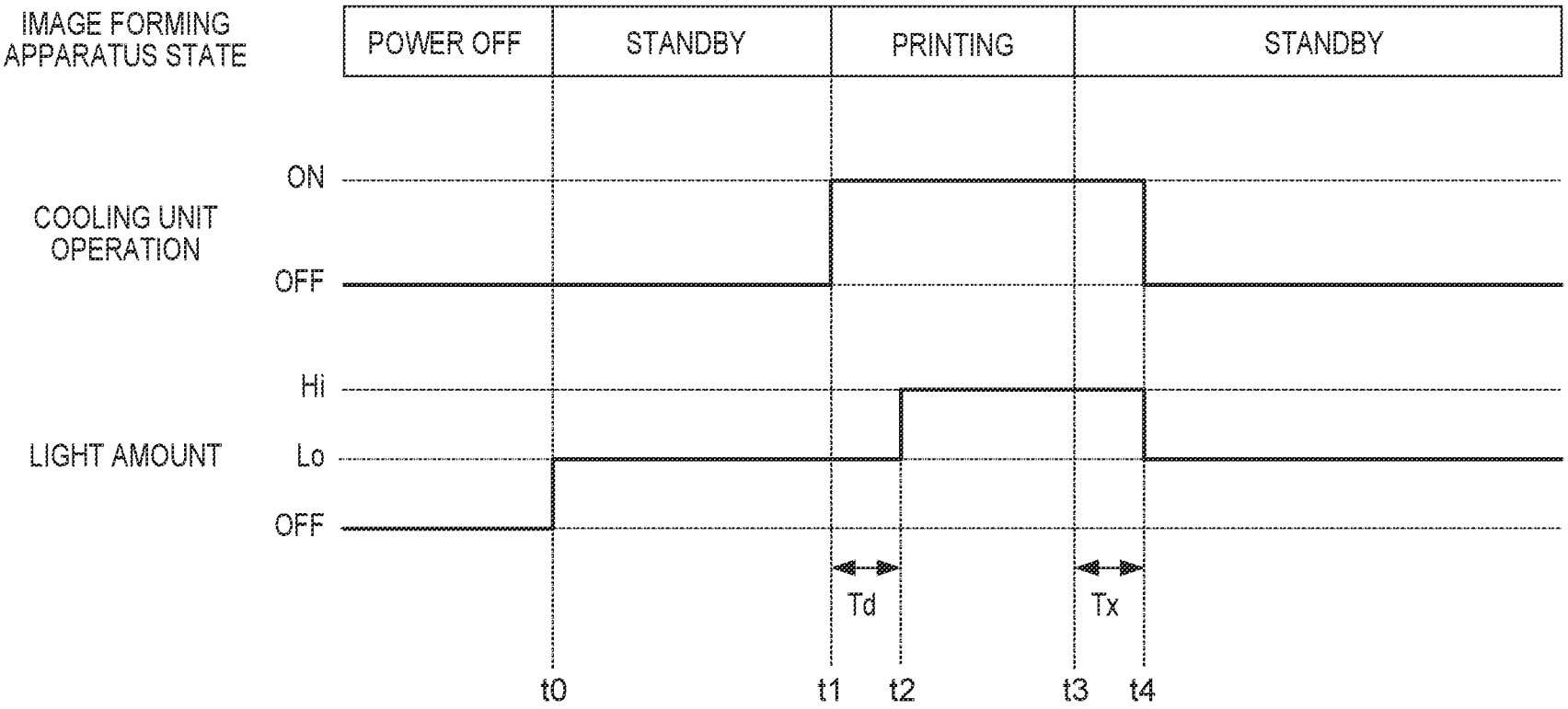
FIG. 7 is a timing chart illustrating light-emission control and cooling control.
Figure 8:
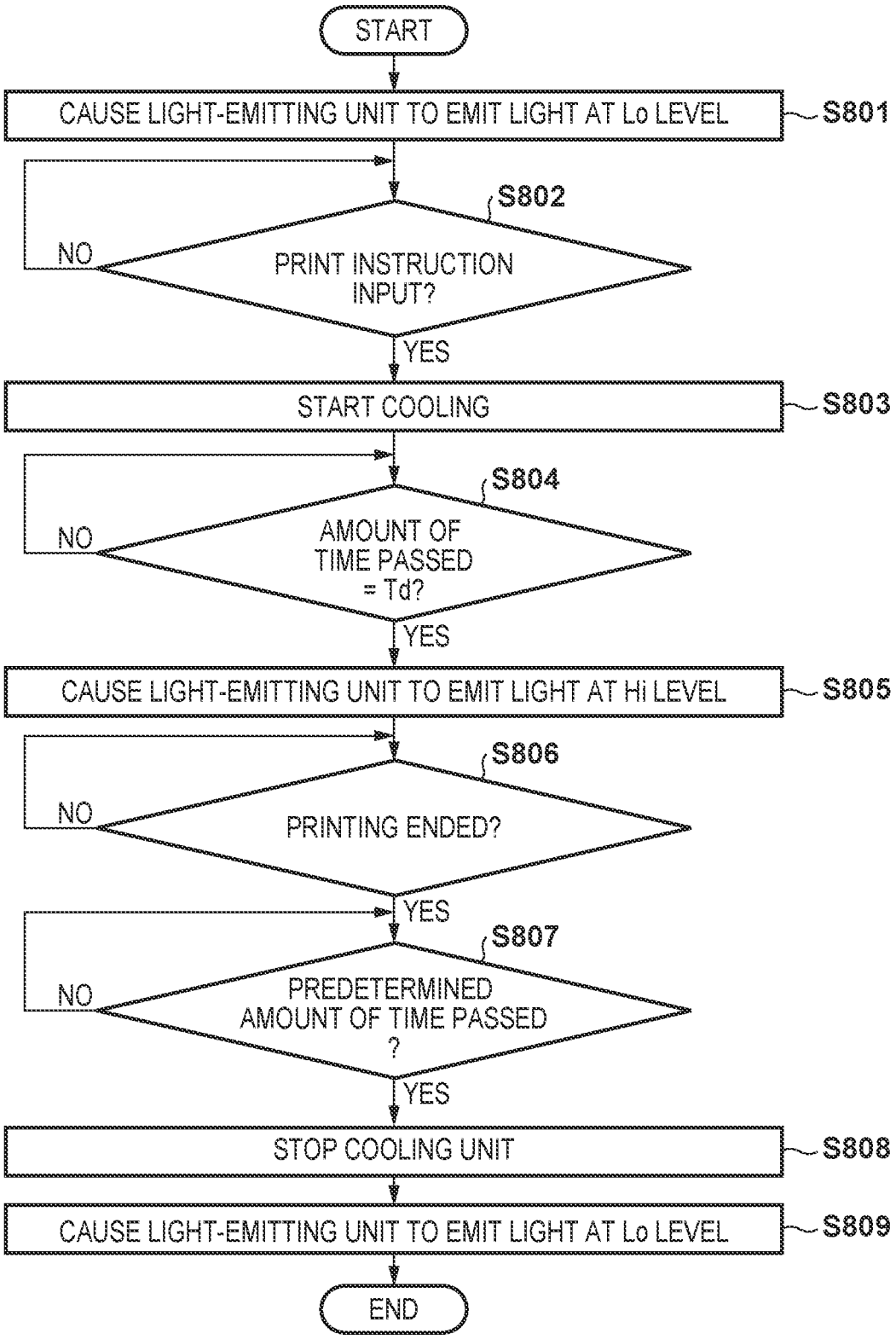
FIG. 8 is a flowchart illustrating light-emission control and cooling control.

FIG. 7 is a timing chart indicating a state of the image forming apparatus 100, operations of the cooling unit 32, and the light amount of the light-emitting unit 33. FIG. 8 is a flowchart illustrating control executed by the CPU 26. As indicated in FIG. 7, the image forming apparatus 100 is started up at time t0.

In S801, the CPU 26 causes the light-emitting unit 33 to emit light at low level. For example, the CPU 26 generates and outputs a PWM signal at a duty corresponding to the low level light emission amount. The CPU 26 also starts a timer for measuring the amount of time Td. The timer may be a counter.

In S802, the CPU 26 determines whether a print instruction (an image forming instruction) has been input from an operation unit, an external computer, or the like. According to FIG. 7, the print instruction is input at time t1. Note that the state of the image forming apparatus from time t0 to time t1 is a standby state of standing by for the print instruction. In the standby state immediately after the image forming apparatus 100 is started up, the cooling unit 32 is not operating (airflow rate=0). However, the CPU 26 may drive the cooling unit 32 at an extremely low airflow rate. When the print instruction is input at time t1, the CPU 26 advances to S803 in order to start image formation.

In S803, the CPU 26 starts cooling the light-emitting unit 33. For example, the CPU 26 starts outputting a PWM signal for driving the cooling unit 32. As a result, power is supplied to the motor of the cooling unit 32, the fan is rotated, and the blowing of air onto the light-emitting unit 33 is started.

In S804, the CPU 26 determines whether the amount of time elapsed from the timing of the start of image formation has reached Td. As indicated in FIG. 7, the CPU 26 advances to S805 upon the amount of time elapsed from time t2 reaching Td. The amount of time Td is an amount of time satisfying Ta<Td<Tb. For example, the amount of time Ta may be 10 seconds, the amount of time Tb may be 20 seconds, and the amount of time Td may be 15 seconds.

In S805, the CPU 26 causes the light-emitting unit 33 to emit light at high level. For example, the CPU 26 changes the duty of the PWM signal so that the light emission amount of the light-emitting unit 33 goes to high level. The light-emitting unit 33 emits light at high level as a result.

In S806, the CPU 26 determines whether or not printing has ended. The CPU 26 determines whether or not all print jobs designated through the operation unit or the like have been completed. When the printing ends at time t3, the CPU 26 advances to S807.

In S807, the CPU 26 determines whether or not the amount of time that has passed from the end of printing has reached a predetermined amount of time Tx. According to FIG. 7, the amount of time that has passed reaches the predetermined amount of time Tx at time t4. The predetermined amount of time Tx is an amount of time necessary for the temperature of the light-emitting unit 33 to drop sufficiently. When the amount of time that has passed reaches the predetermined amount of time Tx, the CPU 26 advances to S808.

In S808, the CPU 26 stops the cooling unit 32. For example, the cooling unit 32 stops the output of the PWM signal or reduces the duty of the PWM signal. Note that the cooling unit 32 need not be completely stopped. For example, the duty of the PWM signal may be changed so that the airflow rate of the cooling unit 32 becomes an extremely low airflow rate.

In S809, the CPU 26 switches the light emission amount of the light-emitting unit 33 from high level to low level and causes the light-emitting unit 33 to emit light at low level. For example, the CPU 26 changes the duty of the PWM signal from a duty corresponding to the high level to a duty corresponding to the low level.

In this manner, when the image forming apparatus 100 is started up at time t0, the cooling unit 32 is driven so as to produce the first airflow rate (which may be zero). At time t1, the cooling unit 32 is driven so that the airflow rate changes from the first airflow rate to the second airflow rate. From when the printing ends at time t3 to when the predetermined amount of time Tx has passed, the cooling unit 32 continues to blow air at the second airflow rate. At time t4, the airflow rate of the cooling unit 32 is reduced from the second airflow rate to the first airflow rate (which may be zero). Note that the CPU 26 may control the airflow rate of the cooling unit 32 to be zero from time t0 to time t1, control the airflow rate to be the first airflow rate (>0) from time t1 to time t2, and control the airflow rate to be the second airflow rate (> the first airflow rate and 0) from time t2 on.

As indicated in FIG. 6B, the temperature of the reflecting member 38 exceeds the dew point temperature in the periphery of the reflecting member 38 at time t10. In other words, the condensation on the reflecting member 38 is gradually eliminated from time t10. Referring to FIG. 6C, it can be seen that reducing the condensation soon causes the reflectance of the reflecting member 38 to exceed the limit reflectance R. The reflectance of the reflecting member 38 is assumed to exceed the limit reflectance R at time t11. Accordingly, the CPU 26 may switch the light emission amount of the light-emitting unit 33 from high level to low level at time t11.

According to this embodiment, the light emission amount of the light-emitting unit 33 is increased at a predetermined timing on the basis of the temperature of the sheet sensor 31 and the degree of condensation. Accordingly, a sheet can be detected accurately even in environments where condensation can arise.

In this embodiment, the condensation state is determined on the basis of the amount of time Td. However, the invention is not limited thereto. The CPU 26 may determine the condensation state on the basis of an input voltage value. In other words, the CPU 26 may decide the timing at which to change the light amount of the light-emitting unit 33 on the basis of the amount of light received by the light-receiving unit 34. For example, in S804, the CPU 26 determines whether or not the voltage value input to the CPU 26 when there is no sheet P present is greater than or equal to a threshold. If the voltage value input to the CPU 26 is less than the threshold, the CPU 26 keeps the amount of light emitted by the light-emitting unit 33 at low level. This makes it likely that a sheet can be detected accurately even in environments where condensation can arise.

Here, in FIG. 6C, the reflectance of the reflecting member 38 at the timing when the amount of time Td has passed is indicated by R'. In the above-described method of determining the condensation state on the basis of a voltage value input to the CPU 26, the CPU 26 decides the threshold using this reflectance R'. In other words, the voltage value input to the CPU 26 in a state where the reflectance of the reflecting member 38 has dropped to R' is used as the threshold.

Second Embodiment

The second embodiment is an improvement on the first embodiment. In the second embodiment, the light emission amount at high level is decided in accordance with the temperature of the heating roller 18 or the temperature of the heater 30 provided in the heating roller 18. The temperature of the heating roller 18 or the heater 30 serves as a measure of how difficult it is for condensation to form. Accordingly, power is saved and the lifespan of the light-emitting unit 33 is extended by not increasing the light emission amount of the light-emitting unit 33 in situations where it is difficult for condensation to form.

Figure 9:
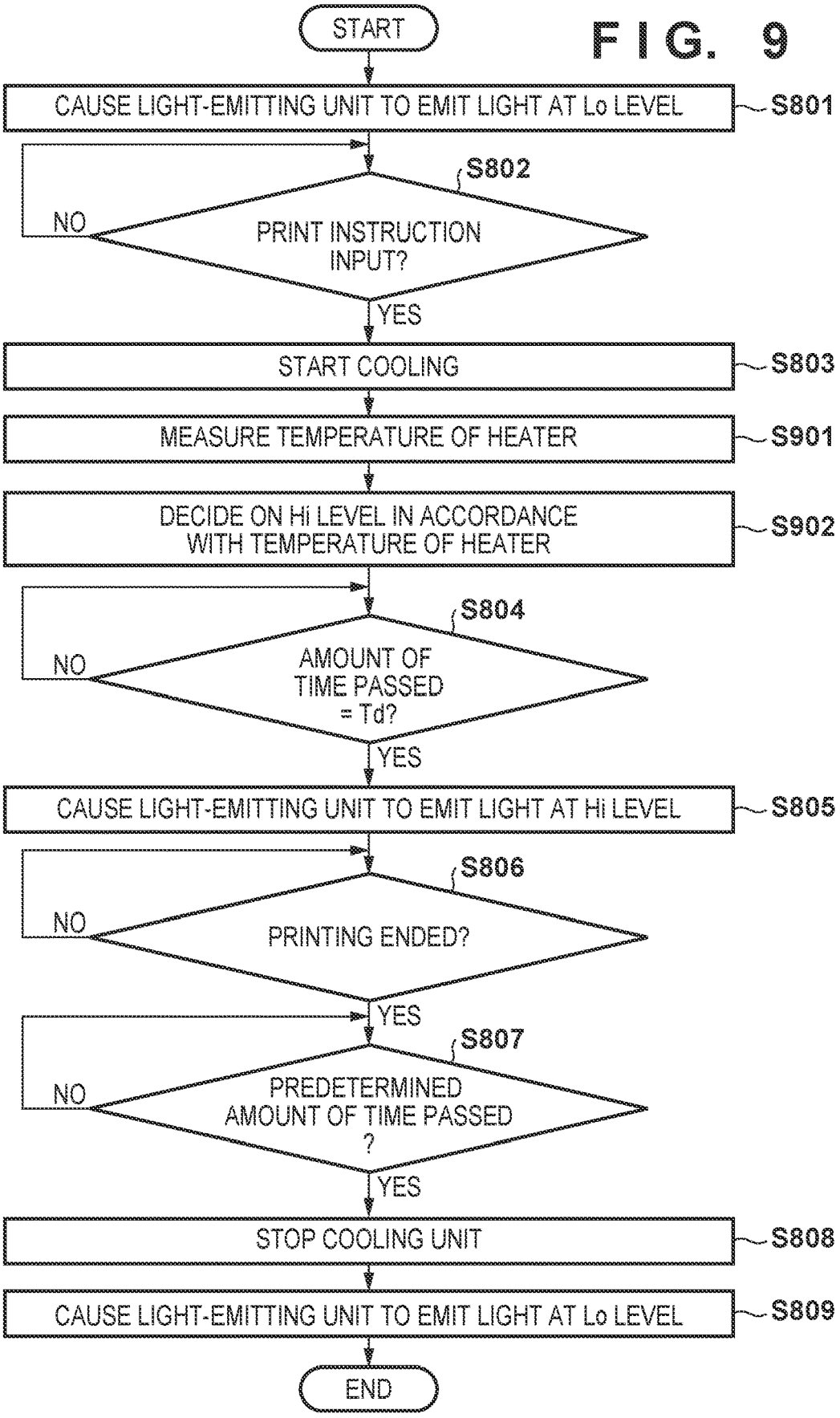
FIG. 9 is a flowchart illustrating light-emission control and cooling control.

FIG. 9 is a flowchart illustrating control executed by the CPU 26 according to the second embodiment. In FIG. 9, parts that are the same as in FIG. 8 are given the same reference signs. In the second embodiment, S901 and S902 are added between S803 and S804. In S901, the CPU 26 measures the temperature of the heater 30 using the temperature sensor 12. In S902, the CPU 26 decides the high level light emission amount in accordance with the measured temperature. The CPU 26 measures the temperature of the heater 30 or the heating roller 18 using the temperature sensor 12, which is a thermistor or the like. Arithmetic equations, conversion tables, and so on for converting temperatures into high level values are stored in a non-volatile memory or the like when the image forming apparatus 100 is shipped from the factory. The CPU 26 reads out the arithmetic equations, conversion tables, and so on, and decides the high level value corresponding to the temperature.

For example, if the detected temperature of the heater 30 is higher than a predetermined temperature, the CPU 26 may set high level to the same value as low level. This is because if the detected temperature of the heater 30 is higher than the predetermined temperature, the reflectance will not drop below the limit reflectance R. On the other hand, if the detected temperature of the heater 30 is not higher than the predetermined temperature, the CPU 26 sets high level to a higher value than low level. This is because if the detected temperature of the heater 30 is less than or equal to the predetermined temperature, the reflectance may drop below the limit reflectance R.

According to this embodiment, the light emission amount is decided on dynamically in accordance with the temperature within or near the fixing apparatus 17. It is not necessary to increase the light amount of the light-emitting unit 33 in a situation where it is difficult for condensation to form, and thus degradation of the light-emitting unit 33 can be reduced. Meanwhile, in a situation where it is easy for condensation to form, a sufficient amount of received light can be ensured by increasing the light amount of the light-emitting unit 33.

Other (1)

Figure 10:
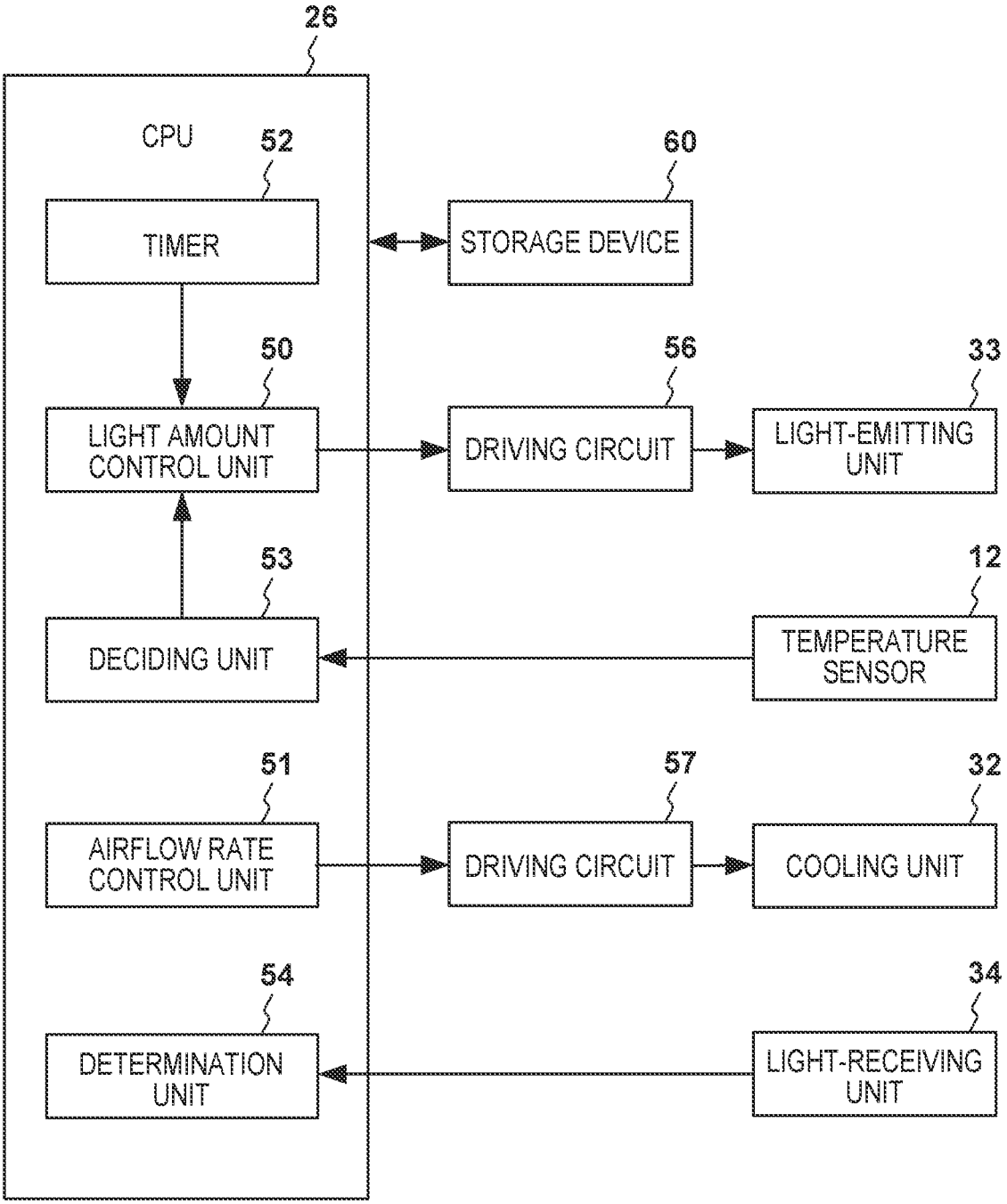
FIG. 10 is a diagram illustrating functions of a CPU.

FIG. 10 illustrates functions realized by the CPU 26 executing a control program stored in a storage device 60. Technical ideas that can be derived from the foregoing embodiments will be described hereinafter with reference to FIG. 10. Note that the storage device 60 includes memory such as RAM or ROM, and holds the control program, conversion tables, thresholds, and so on.

As illustrated in FIG. 3A and the like, the conveyance path 49 is an example of a conveyance path along which the sheet P is conveyed. The light-emitting unit 33 is an example of a light-emitting unit that emits light so that the light crosses the conveyance path 49. A light amount control unit 50 illustrated in FIG. 10 is an example of a light amount control unit that controls the light amount of the light-emitting unit 33. The light amount control unit 50 causes the light-emitting diode D2 of the light-emitting unit 33 to light up via a driving circuit 56 having the circuit configuration illustrated in FIG. 5B. The reflecting member 38 illustrated in FIG. 2B and the like is an example of a reflecting member, provided opposite the light-emitting unit 33, that reflects light. The light-receiving unit 34 is an example of a light-receiving unit that receives the reflected light from the reflecting member 38. The light-receiving unit 34 may be constituted by a photodiode, an amplifying circuit, and the like. The cooling unit 32 is an example of a cooling unit that cools the light-emitting unit 33 by supplying air to the light-emitting unit 33. An airflow rate control unit 51 illustrated in FIG. 10 is an example of an airflow rate control unit that controls the airflow rate of the cooling unit 32. A determination unit 54 is an example of a determination unit that determines whether or not the sheet P is present on the basis of the amount of reflected light received by the light-receiving unit 34. The determination unit 54 may furthermore detect a jam of the sheet P on the basis of the result of determining whether or not the sheet P is present. The light amount control unit 50 may increase the light amount of the light-emitting unit 33 from the first light amount to the second light amount on the basis of the temperature of the light-emitting unit 33 cooled by the cooling unit 32 and the reflectance of the reflecting member 38. For example, as described using FIG. 6C and the like, the light amount control unit 50 increases the light amount of the light-emitting unit 33 from the first light amount (low level) to the second light amount (high level) at any timing within a period from when condensation forms on the reflecting member 38 to when the amount of reflected light drops below a permissible limit. As described above, when the reflectance of the reflecting member 38 drops below the limit reflectance R due to condensation, the amount of reflected light drops below the permissible limit. Accordingly, increasing the light amount during such a period makes it possible to detect a sheet accurately even in environments where condensation can arise.

Note that the light amount control unit 50 may further increase the light amount of the light-emitting unit 33 on the basis of the amount of light received by the light-receiving unit 34. The amount of received light drops when condensation forms. Accordingly, when the amount of received light drops below a predetermined threshold, the light amount control unit 50 may increase the light amount of the light-emitting unit 33 from the first light amount (low level) to the second light amount (high level).

A timer 52 is an example of a counting unit that, as described using FIG. 7, counts the amount of time that has passed from when the cooling unit 32 starts cooling operations. The light amount control unit 50 increases the light amount of the light-emitting unit 33 from the first light amount to the second light amount upon the amount of time that has passed reaching the predetermined amount of time Td. Accordingly, a sheet can be detected accurately even in environments where condensation can arise.

The timer 52 may function as a counting unit that, as described using FIG. 7, counts the amount of time that has passed from when the cooling unit 32 has increased the airflow rate from the first airflow rate (zero, for example) to the second airflow rate. The light amount control unit 50 may increase the light amount of the light-emitting unit 33 from the first light amount to the second light amount upon the amount of time that has passed reaching the predetermined amount of time Td. Accordingly, a sheet can be detected accurately even in environments where condensation can arise.

The fixing apparatus 17 is an example of a fixing unit that, as described with reference to FIG. 1, applies heat to a toner image transferred onto a sheet P to fix the toner image onto the sheet P. The temperature sensor 12 may be used as a temperature measurement unit that measures the temperature of the fixing apparatus 17. A deciding unit 53 illustrated in FIG. 10 is an example of a deciding unit that decides the high level, which corresponds to the second light amount, in accordance with the temperature measured by the temperature sensor 12. The amount of radiant heat to which the reflecting member 38 is exposed changes in accordance with the temperature of the fixing apparatus 17. The dew point temperature changes as well. Accordingly, the temperature of the fixing apparatus 17 serves as a measure of how easy it is for condensation to form. Deciding on the value of high level in accordance with the temperature of the fixing apparatus 17 makes it possible to extend the lifespan of the light-emitting unit 33.

The temperature sensor 12 may measure the temperature when the image forming apparatus 100 starts forming an image. The temperature when the image forming apparatus 100 starts forming an image affects the ease at which condensation forms. Accordingly, the ease at which condensation will form can be found in a precise manner by measuring the temperature when the image forming apparatus 100 starts forming an image.

As illustrated in FIG. 1, the light-emitting unit 33, the light-receiving unit 34, and the reflecting member 38 may be disposed within or near the fixing apparatus 17. Such an arrangement makes it easy for condensation on the reflecting member 38 to become a problem, which makes this invention particularly necessary. Note that "near" the fixing apparatus 17 means a position close enough to the fixing apparatus 17 where condensation can form due to the radiant heat of the fixing apparatus 17 and vapor from the sheet P.

Note that the position at which the temperature sensor 12 is arranged may be changed for the temperature sensor 12 to serve as a temperature measurement unit that measures the ambient temperature of the reflecting member 38. Alternatively, a separate temperature sensor different from the temperature sensor 12 may be added. The deciding unit 53 may decide the value of high level in accordance with the ambient temperature of the reflecting member 38. This is because as described using FIG. 6B, the ambient temperature of the reflecting member 38 serves as an indicator of how easy it is for condensation to form. In this case, the temperature sensor 12 may measure the ambient temperature of the reflecting member 38 when the image forming apparatus 100 starts forming an image. This is because the ambient temperature when the image forming apparatus 100 starts forming an image affects the ease at which condensation forms.

As described using FIG. 4, the ventilation duct 40 that leads the air blown from the cooling unit 32 or the air sucked by the cooling unit 32 to the light-emitting unit 33 so as to cool the light-emitting unit 33 may be provided. Providing the ventilation duct 40 makes it possible to efficiently cool the light-emitting unit 33.

The first guide 36 and the second guide 37 are examples of a first guide member and a second guide member, respectively, provided opposite each other in the conveyance path 49 and guiding the sheet P, as indicated in FIG. 3A and so on. The light-emitting unit 33 and the light-receiving unit 34 may be fixed to the first guide 36. The reflecting member 38 may be fixed to the second guide 37. The light shielding member 47 is an example of a light shielding member provided between the light-emitting unit 33 and the light-receiving unit 34. The light shielding member 47 shields direct light directed from the light-emitting unit 33 toward the light-receiving unit 34. When the sheet P is being conveyed along the conveyance path 49 as illustrated in FIG. 3B, almost none of the light emitted from the light-emitting unit 33 reaches the reflecting member 38, but that light does reach the surface of the sheet P. As such, depending on the type (surface state) of the sheet P, it is possible that light will be reflected by the surface of the sheet P and that reflected light will travel toward the light-receiving unit 34. If such reflected light is received by the light-receiving unit 34, it is possible that the light-receiving unit 34 will output a detection signal indicating that the sheet P is not being detected, despite the fact that the sheet P is being conveyed along the conveyance path 49. Accordingly, the light shielding member 47 may be configured to shield at least some of such light reflected by the surface of the sheet P and traveling toward the light-receiving unit 34. The presence or absence of the sheet P can likely be detected accurately as a result. The light shielding member 47 may be configured to shield direct light directed from the light-emitting unit 33 toward the light-receiving unit 34, and guide air from the cooling unit 32 or air moving toward the cooling unit 32 to the reflecting member 38. Through this, paper debris and so on adhering to the reflecting member 38 can be removed, and vapor arising from the sheet P can be expelled from the vicinity of the reflecting member 38. It will likely become difficult for condensation to form as a result.

Note that the image forming apparatus 100 may include a dew point temperature sensor for measuring the dew point temperature, or a temperature sensor and humidity sensor for calculating the dew point temperature. The CPU 26 may estimate the condensation amount from the temperature of the reflecting member 38 and the dew point temperature in the periphery thereof, and then find the timing at which the limit reflectance R will be reached. The CPU 26 then switches the light amount of the light-emitting unit 33 from low level to high level before that timing is reached.

Third Embodiment

Figure 5C:
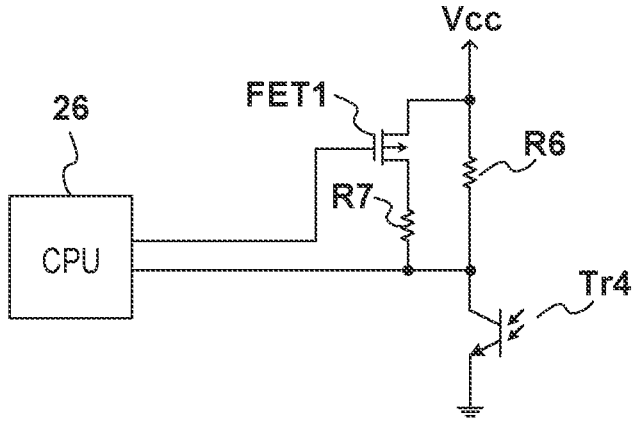

FIG. 5C illustrates a detection circuit of the light-receiving unit 34. The collector side of a phototransistor Tr4 that receives light emitted from the light-emitting unit 33 is connected to the reference voltage Vcc via a pull-up resistor R6, and is also connected to an input port of the CPU 26. The phototransistor Tr4 outputs a voltage based on the amount of light received. As such, the voltage input to the input port of the CPU 26 varies between substantially 0 V and Vcc. The input port may be an AD port such that the CPU 26 can accept an analog value. When an amount of light sufficient to turn the phototransistor Tr4 on has been received, a voltage of substantially 0 V is input to the input port of the CPU 26. On the other hand, when the phototransistor Tr4 cannot receive the reflected light from the reflecting member 38, a voltage substantially equivalent to the reference voltage Vcc is input to the input port. The CPU 26 detects whether or not the sheet P is present on the basis of the voltage input from the input port. For example, if the input voltage is less than or equal to a threshold, the CPU 26 may determine that there is no sheet, whereas if the input voltage exceeds the threshold, the CPU 26 may determine that there is a sheet. A resistor R7 is a resistor provided in order to switch a receiving gain value of the light-receiving unit 34. The CPU 26 turns a FET 1 on by outputting 0 V to the gate of the FET 1 as an on signal. On the other hand, the CPU 26 turns the FET 1 off by outputting Vcc to the gate of the FET 1 as an off signal. When the FET 1 has been turned on, the collector side of the phototransistor Tr4 is connected to the reference voltage Vcc via the combined resistance of the pull-up resistor R6 and the resistor R7. When the FET 1 has been turned off, the collector side of the phototransistor Tr4 is connected to the reference voltage Vcc only via the pull-up resistor R6. In other words, the CPU 26 switches the receiving gain value of the light-receiving unit 34 by outputting the on signal or the off signal to the gate of the FET 1. The CPU 26 sets the receiving gain to a first gain by outputting on signal, and sets the receiving gain to a second gain by outputting off signal. For example, 180 kΩ resistors may be employed as the pull-up resistor R6 and the resistor R7. In this case, when the CPU 26 outputs the on signal for setting the receiving gain to the first gain, the resistance value connected to the reference voltage Vcc is 90 kΩ. On the other hand, when the CPU 26 outputs off signal for setting the receiving gain to the second gain, the resistance value is 180 kΩ. In other words, the second gain is twice the first gain. The resistance value connected to the reference voltage Vcc increases as a result of the CPU 26 outputting the off signal. In other words, compared to the first gain, the second gain can sufficiently reduce the voltage input to the CPU 26 at a lower amount of received light.

Condensation and Gain Control

When condensation forms on the reflecting member 38, the reflectance thereof drops, the amount of light received by the light-receiving unit 34 decreases, and accuracy of detecting the sheet P drops. Taking into consideration the decrease in the amount of light received, it is conceivable to set the receiving gain of the light-receiving unit 34 to constantly be a high value. Doing so makes it possible for the light-receiving unit 34 to output a detection voltage based on whether or not a sheet P is present even if condensation has formed on the reflecting member 38, paper debris has adhered to the reflecting member 38, or the like. However, setting the receiving gain of the light-receiving unit 34 to a high value makes the phototransistor Tr4 more susceptible to the influence of noise arising near the image forming apparatus 100. In other words, the phototransistor Tr4 will be turned on by the noise, and the voltage input to the CPU 26 will become substantially 0 V. The CPU 26 will therefore erroneously determine that there is no sheet P even when the sheet P is actually present. Accordingly, the CPU 26 may reduce the receiving gain if the amount of received light has not dropped due to condensation forming on the reflecting member 38, and may increase the receiving gain if the amount of received light drops. For example, in conditions where a sheet P is not present, the CPU 26 sets the receiving gain of the light-receiving unit 34 to the first gain, and carries out the detection of the sheet P. If the voltage input to the input port exceeds a predetermined threshold, the CPU 26 determines that the amount of received light has dropped.

Figure 11A:
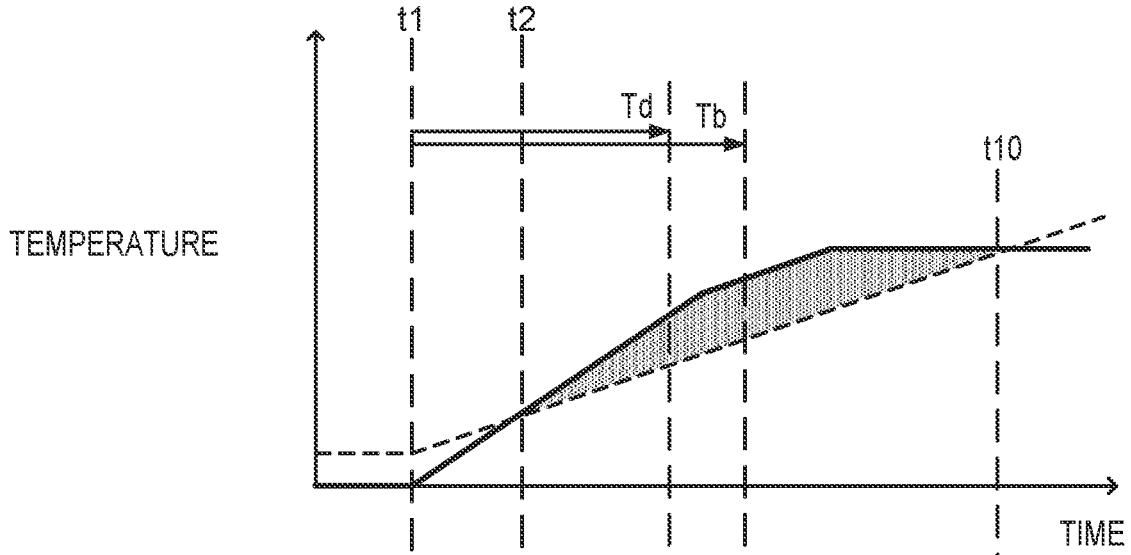
FIGS. 11A to 11C are diagrams illustrating relationships between the temperature of a reflecting member and reflectance.
Figure 11B:
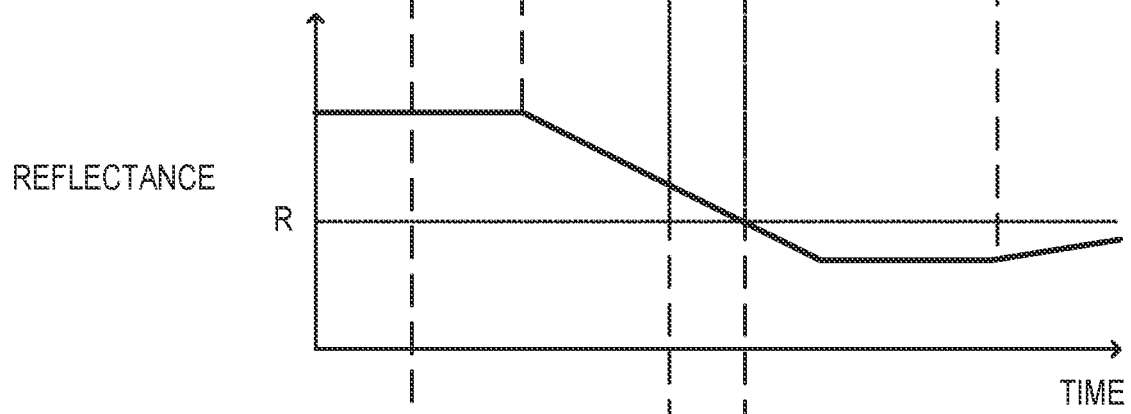
Figure 11C:
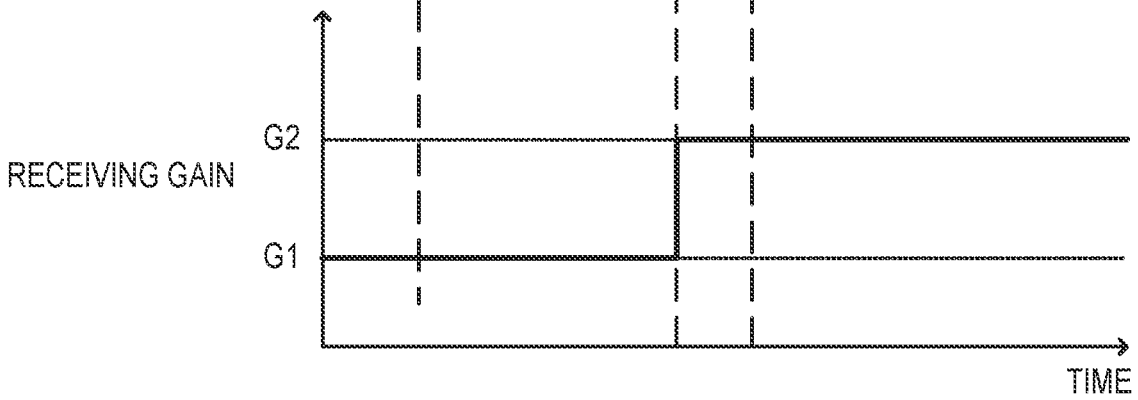

FIG. 11A indicates changes in the temperature of the reflecting member 38 (the broken line) and a dew point temperature (the solid line). Note that the hatched region between the broken line in the solid line indicates the condensation has formed on the reflecting member 38. FIG. 11B indicates changes in the reflectance of the reflecting member 38. FIG. 11C indicates changes in a setting value of the receiving gain in this embodiment.

The CPU 26 starts forming an image at time t1. As indicated by the broken line in FIG. 11A, the reflecting member 38 is exposed to radiant heat from the heat source of the fixing apparatus 17, and thus the temperature of the reflecting member 38 rises. As indicated by the solid line in FIG. 11A, the dew point temperature in the periphery of the reflecting member 38 increases as the image forming time lengthens. This is because as the ambient temperature of the reflecting member 38 rises, moisture in the sheet P is vaporized by the fixing apparatus 17, and the amount of vapor in the periphery of the reflecting member 38 increases as a result. As indicated in FIG. 11A, condensation forms on the reflecting member 38 when the dew point temperature exceeds the temperature of the reflecting member 38 at time t2.

As indicated in FIG. 11B, the condensation forming on the reflecting member 38 causes a drop in the reflectance of the reflecting member 38. The amount of reflected light incident on the light-receiving unit 34 drops as the reflectance of the reflecting member 38 drops. When the amount of received light drops below an amount of light necessary to detect whether or not a sheet P is present, the CPU 26 will mistakenly detect a sheet P as being present even when there is no sheet P. As illustrated in FIG. 11B, the limit reflectance R is a lower limit reflectance at which erroneous detection will occur when the receiving gain of the light-receiving unit 34 is a first gain G1. The timing at which the reflectance becomes the limit reflectance R corresponds to an amount of time Tb passing from time t1. The reflectance drops below the limit reflectance R upon the amount of time Tb elapsing.

Accordingly, as illustrated in FIG. 11C, the CPU 26 switches the receiving gain of the light-receiving unit 34 from the first gain G1 to a second gain G2 upon the amount of time Td passing from time t1. This reduces the amount of light necessary to determine that no sheet is present, which improves the accuracy of detecting the sheet P.

Figure 12:
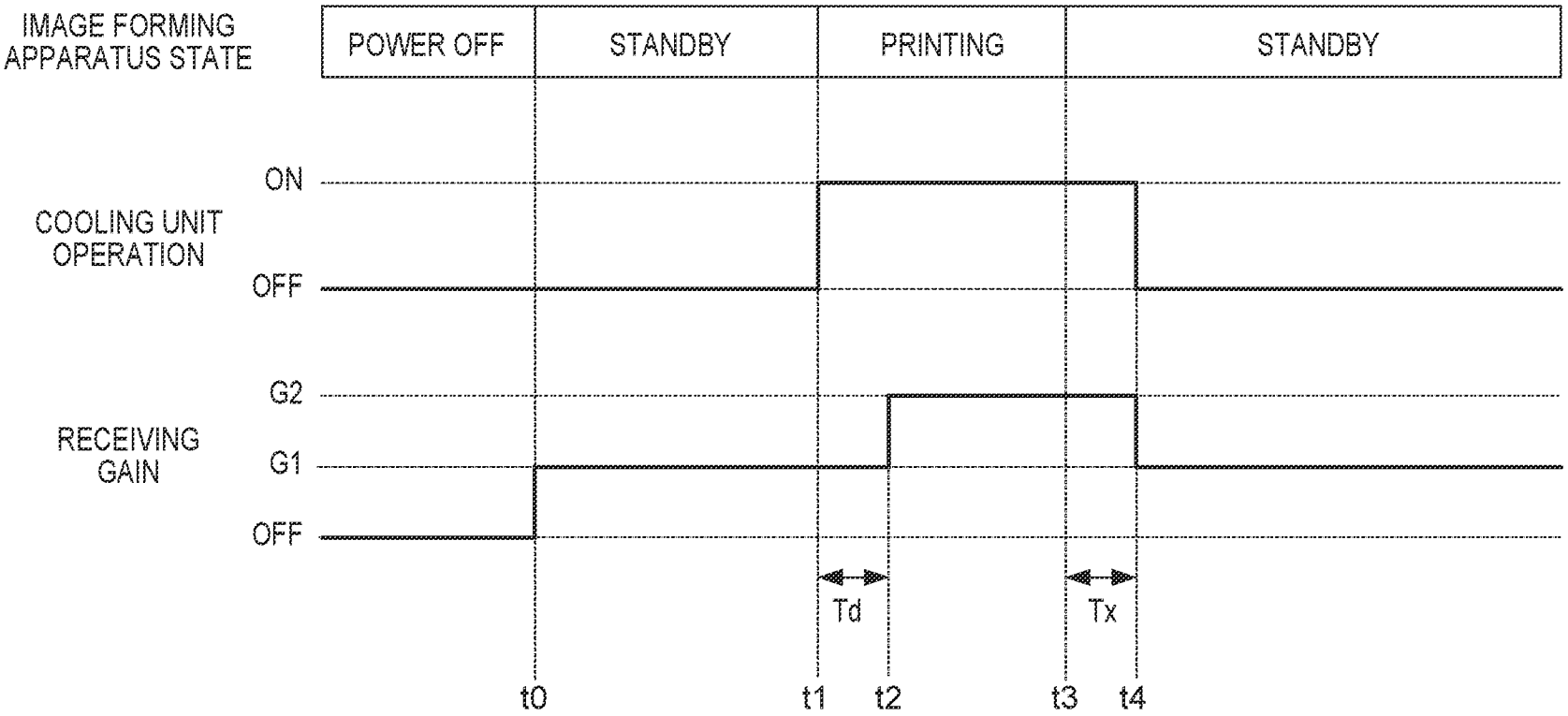
FIG. 12 is a timing chart illustrating light-receiving gain control and cooling control.
Figure 13:
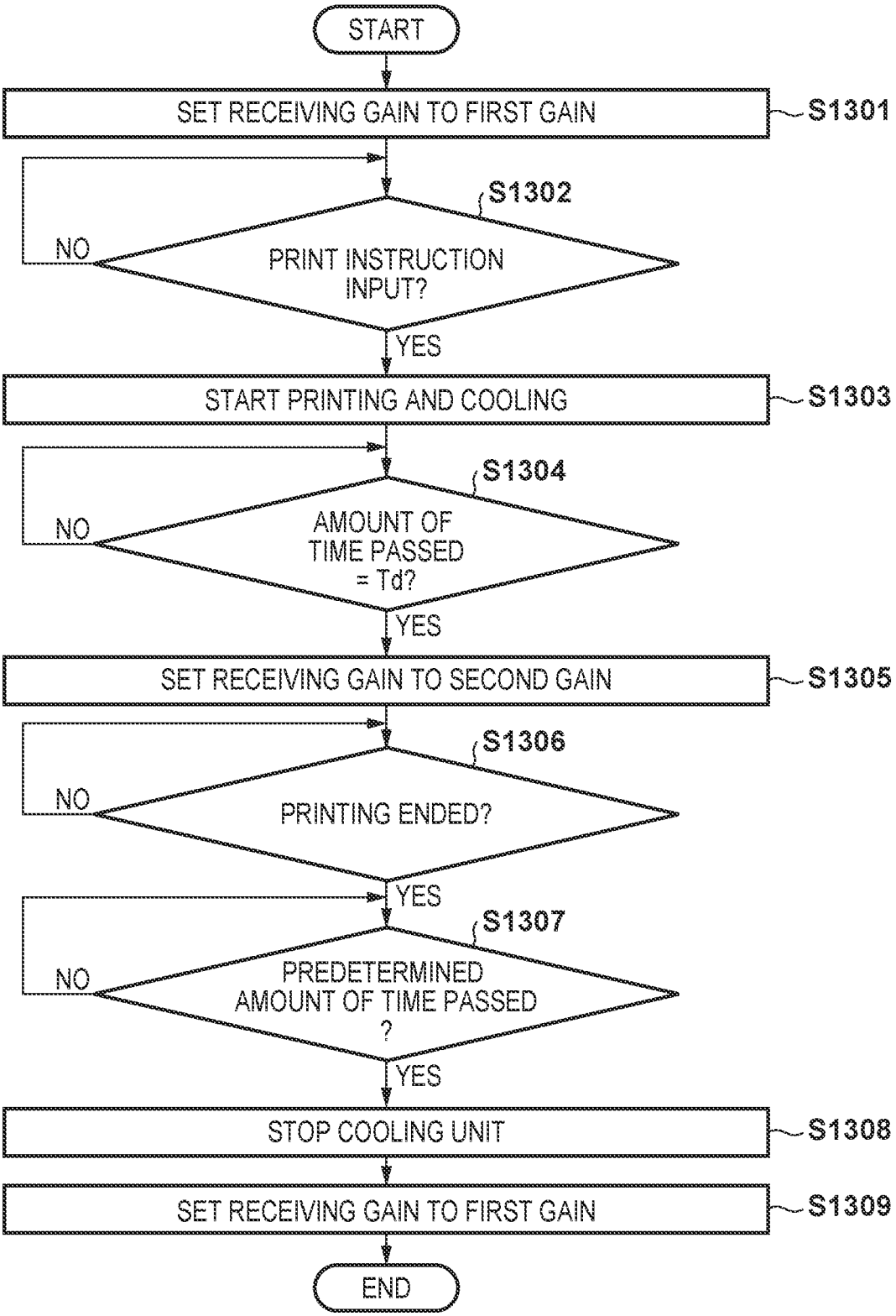
FIG. 13 is a flowchart illustrating light-receiving gain control and cooling control.

FIG. 12 is a timing chart indicating a state of the image forming apparatus 100, operations of the cooling unit 32, and the receiving gain of the light-receiving unit 34. FIG. 13 is a flowchart illustrating control executed by the CPU 26. As indicated in FIG. 12, the image forming apparatus 100 is started up at time t0. The reference voltage Vcc is 0 V until startup, and thus the receiving gain is expressed as "off".

In S1301, the CPU 26 sets the receiving gain of the light-receiving unit 34 to the first gain G1. The CPU 26 also starts a timer for measuring the amount of time Td. The timer may be a counter.

In S1302, the CPU 26 determines whether a print instruction (an image forming instruction) has been input from an operation unit, an external computer, or the like. According to FIG. 12, the print instruction is input at time t1. Note that the state of the image forming apparatus 100 from time t0 to time t1 is a standby state of standing by for the print instruction. In the standby state immediately after the image forming apparatus 100 is started up, the cooling unit 32 is not operating (airflow rate=0). However, the CPU 26 may drive the cooling unit 32 at an extremely low airflow rate. When the print instruction is input at time t1, the CPU 26 advances to S1303 in order to start image formation.

In S1303, the CPU 26 starts printing and cooling the light-emitting unit 33, and starts delivering air to the reflecting member 38. For example, the CPU 26 starts outputting a PWM signal for driving the cooling unit 32. As a result, power is supplied to the motor of the cooling unit 32, the fan is rotated, and the blowing of air onto the light-emitting unit 33 and the reflecting member 38 is started.

In S1304, the CPU 26 determines whether the amount of time that has passed from the timing at which the printing was started has reached Td, on the basis of a timer value obtained from the timer. As indicated in FIG. 12, the CPU 26 advances to S1305 upon the amount of time elapsed from time t2 reaching Td. The amount of time Td is an amount of time satisfying Td<Tb. For example, the amount of time Tb may be 20 seconds and the amount of time Td may be 15 seconds.

In S1305, the CPU 26 sets the receiving gain of the light-receiving unit to the second gain G2. In other words, the receiving gain increases.

In S1306, the CPU 26 determines whether or not printing has ended. For example, the CPU 26 determines whether or not all of the print jobs specified through the operation unit or the like have been completed. When the printing ends at time t3, the CPU 26 advances to S1307.

In S1307, the CPU 26 determines whether or not the amount of time that has passed from the end of printing has reached a predetermined amount of time Tx. According to FIG. 12, the amount of time that has passed reaches the predetermined amount of time Tx at time t4. The predetermined amount of time Tx is an amount of time necessary for the condensation on the reflecting member 38 to disappear. When the amount of time that has passed reaches the predetermined amount of time Tx, the CPU 26 advances to S1308. As indicated in FIG. 11A, the temperature of the reflecting member 38 exceeds the dew point temperature in the periphery of the reflecting member 38 at time t10. In other words, the condensation on the reflecting member 38 is gradually eliminated from time t10. Referring to FIG. 11B, it can be seen that dispersing vapor and reducing condensation by delivering air from the cooling unit 32 soon causes the reflectance of the reflecting member 38 to exceed the limit reflectance R. The reflectance of the reflecting member 38 is assumed to exceed the limit reflectance R at time t11. Accordingly, at time t11, the CPU 26 determines that the receiving gain of the light-receiving unit 34 can be switched from the second gain G2 to the first gain G1.

In S1308, the CPU 26 stops the cooling unit 32. For example, the cooling unit 32 stops the output of the PWM signal or reduces the duty of the PWM signal. Note that the cooling unit 32 need not be stopped. For example, the duty of the PWM signal may be changed so that the airflow rate of the cooling unit 32 becomes an extremely low airflow rate.

In S1309, the CPU 26 sets the receiving gain of the light-receiving unit 34 from the second gain G2 to the first gain G1.

According to this embodiment, the receiving gain of the light-receiving unit 34 is increased at a predetermined timing on the basis of the temperature of the sheet sensor 31 and the degree of condensation. Accordingly, a sheet P can be detected accurately even in environments where condensation can arise. Additionally, the influence of noise that can arise near the image forming apparatus 100 is reduced by setting the receiving gain of the light-receiving unit 34 to the first gain G1 in situations where condensation does not occur. In other words, erroneous operations of the phototransistor Tr4 will likely be reduced, and erroneous detections of the sheet P will also likely be reduced.

In this embodiment, the condensation state is determined on the basis of the amount of time Td. As described above, the CPU 26 may determine the condensation state on the basis of an input voltage value. In other words, the timing at which to change the receiving gain may be decided on the basis of the amount of light received by the light-receiving unit 34. In this case, in S1304, the CPU 26 determines whether or not the voltage value input to the CPU 26 when there is no sheet P present is greater than or equal to a threshold. If the voltage value input to the CPU 26 is less than the threshold, the CPU 26 keeps the receiving gain at the first gain G1. Through this, it is likely that erroneous detections of the sheet P caused by noise will be reduced, and the sheets P will be detected accurately.

Incidentally, there are cases where the printing ends before the amount of time that has passed reaches Td. In such a case too, when the amount of time that has passed is determined to have reached Td in S1304, the receiving gain will be switched to the second gain G2 in S1305. However, if the printing has already ended, less vapor will be produced as well. Accordingly, the CPU 26 may determine to end the printing between S1304 and S1305. If the printing ends before the amount of time that has passed reaches Td, the CPU 26 skips S1305 and S1306. As a result, the receiving gain is not switched to the second gain G2, and is instead kept at the first gain G1.

Fourth Embodiment

The fourth embodiment is an improvement on the third embodiment. In the fourth embodiment, the value of the second gain G2 is decided in accordance with the temperature of the heating roller 18 or the temperature of the heater 30 provided in the heating roller 18. The temperature of the heating roller 18 or the heater 30 serves as a measure of how difficult it is for condensation to form. Accordingly, robust sheet detection with excellent resistance to noise is realized by reducing the value of the receiving gain of the light-receiving unit 34 in situations where it is difficult for condensation to form.

Figure 14:
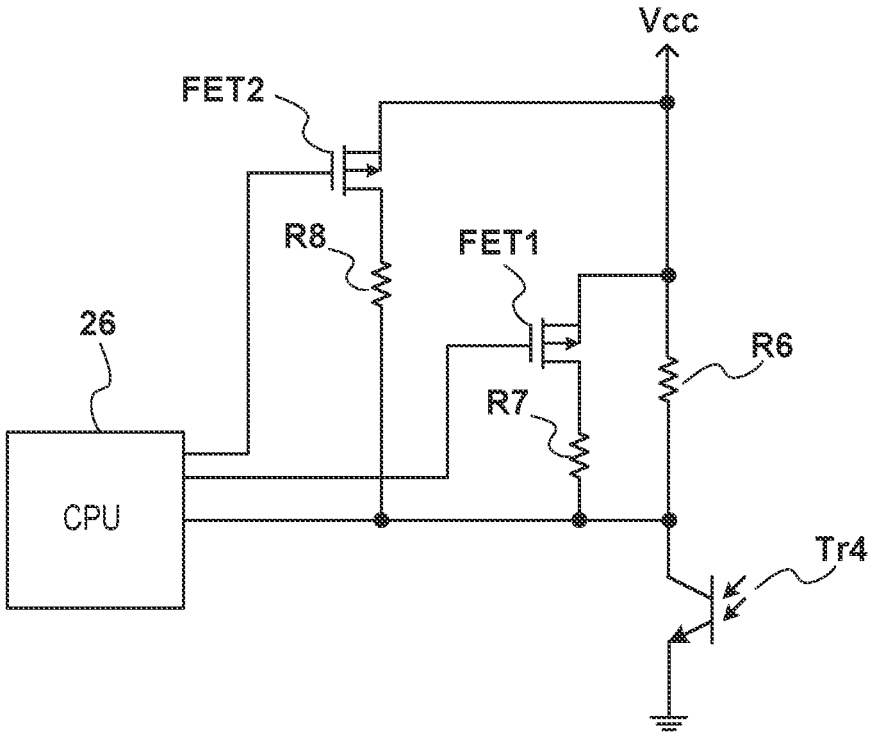
FIG. 14 is a diagram illustrating a detection circuit of a sheet sensor.

FIG. 14 illustrates a detection circuit of the light-receiving unit 34 according to the fourth embodiment. A resistor R8 and a FET 2 have been added to the configuration illustrated in FIG. 5C. The CPU 26 switches the receiving gain of the light-receiving unit 34 by controlling operations of the FET 2. For example, the CPU 26 can set a receiving gain different from the receiving gain described in the third embodiment by outputting 0 V as an on signal to the gate of the FET 2. For example, when R8 is 560 kΩ, the CPU 26 outputs the off signal to the FET 1, and the CPU 26 outputs the on signal to the FET 2, the resistance value connected to the reference voltage Vcc is approximately 136 kΩ. In other words, the second gain G2 is 1.5 times the first gain G1. By the CPU 26 outputting the off signal to the FET 1 and the on signal to the FET 2, a second gain G2' higher than the first gain G1 but lower than the second gain G2 according to the third embodiment can be set as the receiving gain. In other words, the second gain G2 is set to 1.5 times or twice the first gain G1 in accordance with whether the FET 2 is on or off. The CPU 26 can adjust the receiving gain over three stages in this manner.

Figure 15:
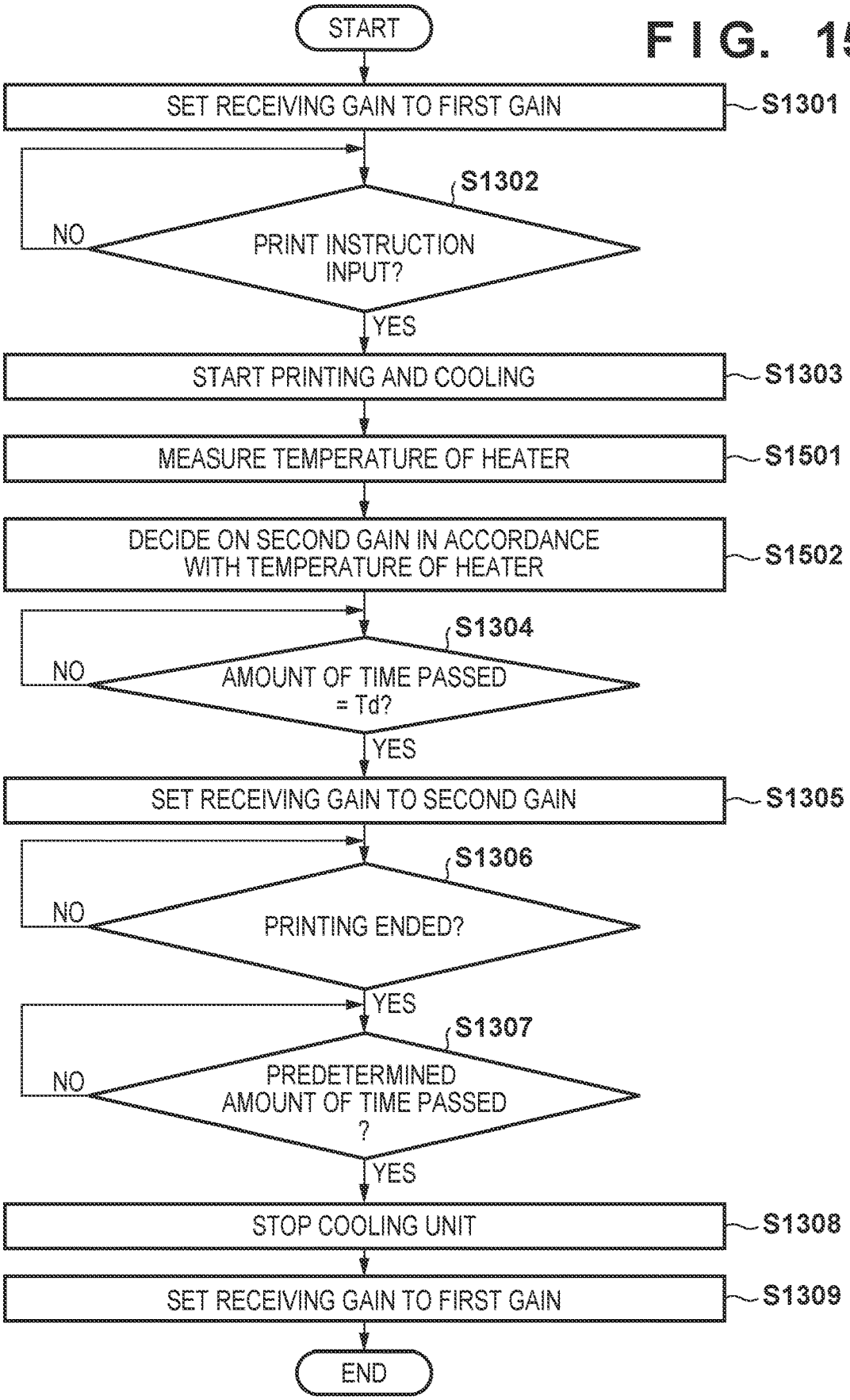
FIG. 15 is a flowchart illustrating light-receiving gain control and cooling control.

FIG. 15 is a flowchart illustrating control executed by the CPU 26 according to the fourth embodiment. In FIG. 15, parts that are the same as in FIG. 13 are given the same reference signs. In the fourth embodiment, S1501 and S1502 have been added between S1303 and S1304. In S1501, the CPU 26 measures the temperature of the heater 30 using the temperature sensor 12. In S1502, the CPU 26 decides the second gain G2 in accordance with the measured temperature. The CPU 26 measures the temperature of the heater 30 or the heating roller 18 using the temperature sensor 12, which is a thermistor or the like. Arithmetic equations, conversion tables, and so on for converting temperatures into the second gain are stored in a non-volatile memory or the like when the image forming apparatus 100 is shipped from the factory. The CPU 26 sets the second gain G2 corresponding to the temperature by using the arithmetic equations, conversion tables, and so on, and controls the operations of the FET 1 and the FET 2 in accordance with the second gain G2. In other words, the CPU 26 decides whether to turn the signal applied to the gate of the FET 1 on or off and whether to turn the signal applied to the gate of the FET 2 on or off in accordance with the temperature.

For example, if the detected temperature of the heater 30 is higher than a predetermined temperature, the CPU 26 outputs the off signal to the FET 1 and outputs the on signal to the FET 2. The second gain G2 that is approximately 1.5 times the first gain G1 is set in the light-receiving unit 34 as a result. This is because if the detected temperature of the heater 30 is higher than the predetermined temperature, the reflectance will not drop below the limit reflectance R. On the other hand, if the detected temperature of the heater 30 is not higher than the predetermined temperature, the CPU 26 outputs the off signal to the FET 1 and the FET 2. The second gain G2 that is approximately 2 times the first gain G1 is set in the light-receiving unit 34 as a result. This is because if the detected temperature of the heater 30 is less than or equal to the predetermined temperature, the reflectance may drop below the limit reflectance R.

According to this embodiment, the receiving gain is decided on in accordance with the temperature within or near the fixing apparatus 17. The receiving gain of the light-receiving unit 34 thus will not be set higher than necessary in situations where it is difficult for condensation to form. The sheet detection becomes less susceptible to the effects of noise arising near the image forming apparatus 100 as a result. In other words, the fourth embodiment is likely to improve the accuracy of detecting sheets more than in the third embodiment. The receiving gain of the light-receiving unit 34 is increased in situations where it is easy for condensation to form. Through this, the light amount indicating that no sheet P is present will drop, and the accuracy of determining that there is no sheet is improved.

Fifth Embodiment

The fifth embodiment adds a configuration for changing the light emission amount of the light-emitting unit 33 to the configuration of the third embodiment. A configuration for changing the light emission amount of the light-emitting unit 33 may be added to the configuration of the fourth embodiment. In the fifth embodiment, a PWM signal is outputted from the CPU 26 to the light-emitting unit 33 as a driving signal. Changing the light emission amount of the light-emitting unit 33 along with the receiving gain of the light-receiving unit 34 realizes sheet detection that is resistant to noise while also reducing degradation of the light-emitting unit 33.

Figure 16:
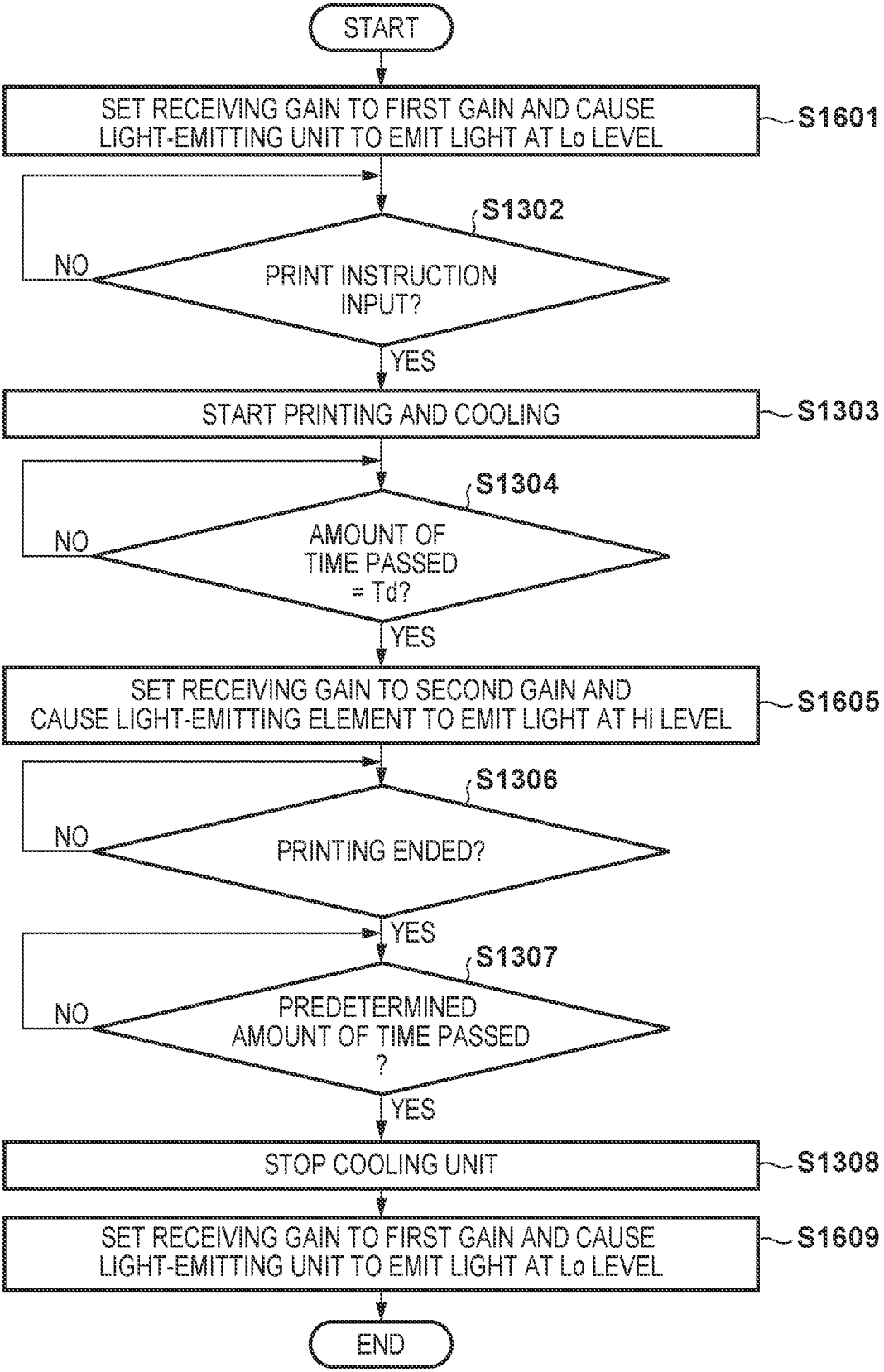
FIG. 16 is a flowchart illustrating light-receiving gain control and cooling control.

FIG. 16 is a flowchart illustrating control executed by the CPU 26 according to the fifth embodiment. In FIG. 16, parts that are the same as in FIG. 13 are given the same reference signs. In the fifth embodiment, S1301, S1305, and S1309 are replaced with S1601, S1605, and S1609, respectively.

In S1601, the CPU 26 sets the receiving gain of the light-receiving unit 34 to the first gain G1, and sets the light emission amount of the light-emitting unit 33 to low level. The CPU 26 switches the amount of light emitted by the light-emitting unit 33 by changing the duty of the PWM signal. For example, by outputting a PWM signal having a first duty, the CPU 26 sets the amount of light emitted by the light-emitting unit 33 to low level, which is a first light amount.

In S1605, the CPU 26 changes the receiving gain of the light-receiving unit 34 from the first gain G1 to the second gain G2, and changes the light emission amount of the light-emitting unit 33. By outputting a PWM signal having a second duty, the CPU 26 sets the amount of light emitted by the light-emitting unit 33 to high level, which is a second light amount. By setting the second duty to be greater than the first duty, the second light amount will be greater than the first light amount. Note that the second gain G2 according to the fifth embodiment may be lower than the second gain G2 according to the third embodiment. This is because the light emission amount of the light-emitting unit 33 will be increased.

In S1609, the CPU 26 changes the receiving gain of the light-receiving unit 34 from the second gain G2 to the first gain G1, and changes the light emission amount of the light-emitting unit 33 from high level to low level.

According to this embodiment, the receiving gain of the light-receiving unit 34 and the light emission amount of the light-emitting unit 33 are increased at a predetermined timing on the basis of the temperature of the sheet sensor 31 and the degree of condensation. Accordingly, a sheet can be detected accurately even in environments where condensation can arise. Additionally, by increasing the light emission amount of the light-emitting unit 33, an increase in the receiving gain of the light-receiving unit 34 can be suppressed and a sheet can also be detected. The resistance to noise can be improved as a result.

In this embodiment, the receiving gain of the light-receiving unit 34 and the light amount of the light-emitting unit 33 are switched. However, the receiving gain of the light-receiving unit 34 and the light amount of the light-emitting unit 33 may instead be switched independently. In other words, the conditions for increasing/reducing the receiving gain may be different from the conditions for increasing/reducing the light emission amount. This makes it possible to apply a more diverse range of conditions.

Other (2)

Figure 17:
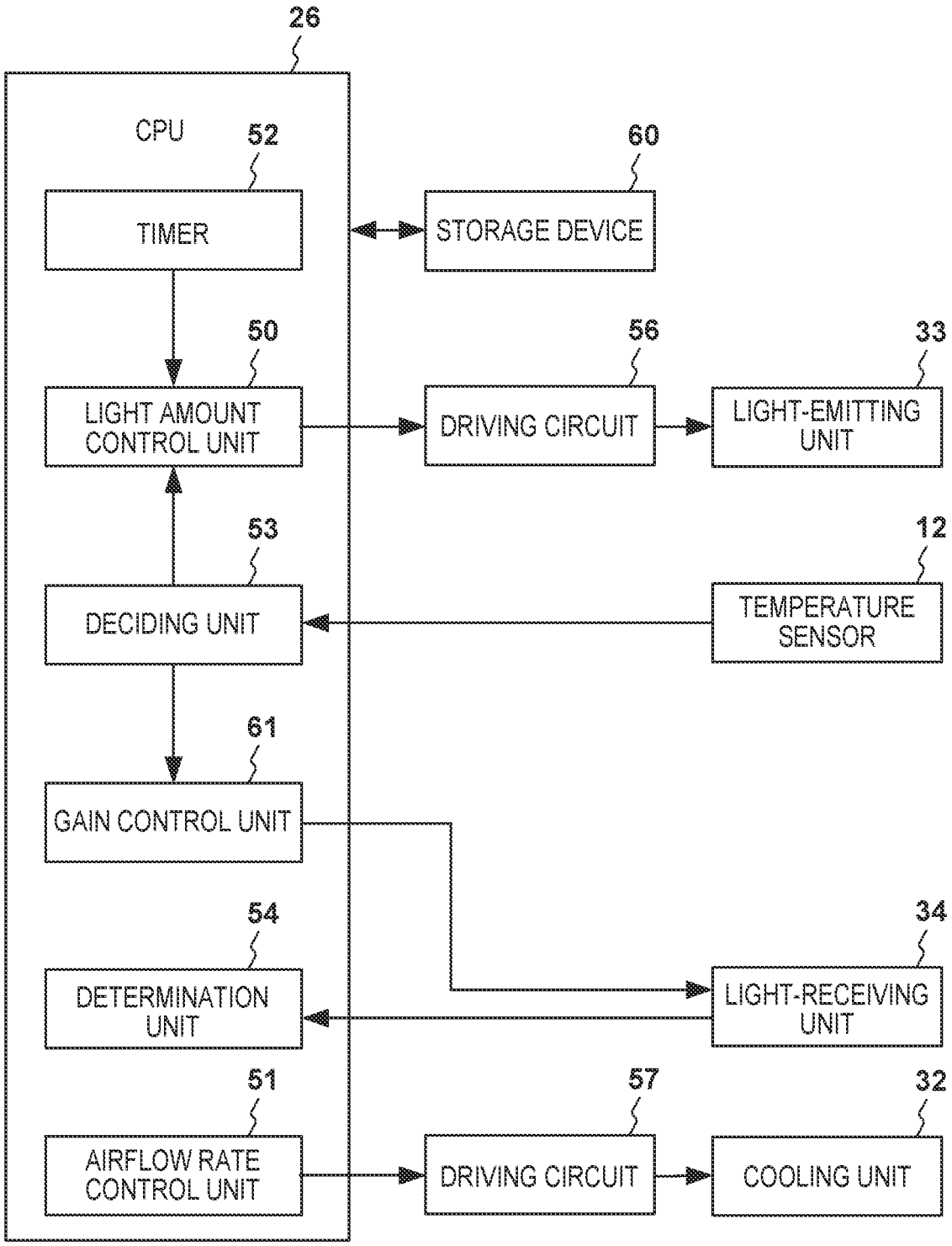
FIG. 17 is a diagram illustrating functions of a CPU.

FIG. 17 illustrates functions realized by the CPU 26 executing a control program stored in a storage device 60. Technical ideas that can be derived from the foregoing embodiments will be described hereinafter with reference to FIG. 17. Note that the storage device 60 includes memory such as RAM or ROM, and holds the control program, conversion equations, conversion tables, thresholds, and so on. In FIG. 17, parts that are the same as in FIG. 10 are given the same reference signs, and descriptions thereof will basically be omitted.

A gain control unit 61 changes the voltage generated by the phototransistor Tr4 by controlling the receiving gain in the detection circuit illustrated in FIG. 5C. The cooling unit 32 is an example of a cooling unit that cleans the reflecting member 38 while cooling the light-emitting unit 33 by supplying air to the light-emitting unit 33. The gain control unit 61 may increase the receiving gain of the light-receiving unit 34 from the first gain to the second gain on the basis of the reflectance of the reflecting member 38. For example, as described using FIG. 11B and the like, the gain control unit 61 increases the receiving gain of the light-receiving unit 34 from the first gain to the second gain at any timing within a period from when condensation begins to form on the reflecting member 38 to when the amount of reflected light drops below a permissible limit. As described above, when the reflectance of the reflecting member 38 drops below the limit reflectance R due to condensation, the amount of reflected light drops below the permissible limit. Accordingly, increasing the receiving gain during such a period makes it possible to detect a sheet accurately even in environments where condensation can arise.

The gain control unit 61 furthermore increases the receiving gain of the light-receiving unit 34 on the basis of the amount of light received by the light-receiving unit 34. For example, the gain control unit 61 may increase the receiving gain from the first gain to the second gain upon the amount of light received by the light-receiving unit 34 dropping below a threshold.

A timer 52 is an example of a counting unit that, as described using FIG. 12, counts the amount of time that has passed from the timing at which the cooling unit 32 starts cooling operations. The gain control unit 61 increases the receiving gain of the light-receiving unit 34 from the first gain to the second gain when the amount of time that has passed reaches the predetermined amount of time Td. Accordingly, a sheet can be detected accurately even in environments where condensation can arise.

A deciding unit 53 illustrated in FIG. 17 is an example of a deciding unit that decides the value of the receiving gain in accordance with the temperature measured by the temperature sensor 12. The receiving gain is decided on in accordance with the temperature of the fixing apparatus 17, and thus the resistance to noise can likely be improved.

The deciding unit 53 may decide the value of high level and the receiving gain in accordance with the ambient temperature of the reflecting member 38.

As described using FIG. 4, the ventilation duct 40 that leads the air blown from the cooling unit 32 or the air sucked by the cooling unit 32 to the reflecting member 38 so as to blow on the reflecting member 38 may be provided. By providing the ventilation duct 40 in this manner, the reflecting member 38 can be cleaned efficiently, and vapor arising from the sheet P can be expelled from the vicinity of the reflecting member 38.

Note that the image forming apparatus 100 may include a dew point temperature sensor for measuring the dew point temperature, or a temperature sensor and humidity sensor for calculating the dew point temperature. These may function as a condensation detection unit that detects condensation on the reflecting member 38. The CPU 26 may decide a period from when condensation begins to form on the reflecting member 38 to when the amount of reflected light received by the light-receiving unit 34 drops below the permissible limit on the basis of a detection result from the condensation detection unit. For example, the CPU 26 may estimate the condensation amount from the temperature of the reflecting member 38 and the dew point temperature in the periphery thereof, and then find the timing at which the limit reflectance R will be reached. The CPU 26 switches the receiving gain of the light-receiving unit 34 from the first gain to the second gain before this timing is reached.

As illustrated in FIGS. 5C and 14, the light-receiving unit 34 may include the phototransistor Tr4, which is a light-receiving element, and a variable resistor connected between the light-receiving element and the CPU 26, which serves as the determination unit. Note that the resistors R6, R7, and R8 and the FETs 1 and 2 are examples of variable resistors. The gain control unit 61 may control the receiving gain by changing a resistance value of the variable resistor. The variable resistor may include at least two of the resistors R6, R7, and R8 connected in parallel, and the switching element FETs 1 and 2 connected in series to at least one of the resistors R7 and R8 of the at least two resistors. The gain control unit 61 may control the receiving gain by controlling the switching elements and changing a combined resistance value of the at least two resistors.

According to FIG. 2A and the like, the light output from the light-emitting unit 33 crosses the conveyance path 49 and is incident on the reflecting member 38, and the reflected light from the reflecting member 38 also crosses the conveyance path 49 and is incident on the light-receiving unit 34. In this manner, the light output from the light-emitting unit 33 crosses the conveyance path 49 twice, but it is sufficient for the number of times the light crosses the conveyance path 49 to be one or more. For example, the light output from the light-emitting unit 33 may be incident on the reflecting member 38 without crossing the conveyance path 49, and the reflected light from the reflecting member 38 may then cross the conveyance path 49 and be incident on the light-receiving unit 34. Additionally, the light output from the light-emitting unit 33 may cross the conveyance path 49 and be incident on the reflecting member 38, and the reflected light from the reflecting member 38 may then be incident on the light-receiving unit 34 without crossing the conveyance path 49. The number of times the light crosses the conveyance path 49 may be one. The light output from the light-emitting unit 33 may cross the conveyance path 49 and be incident on the reflecting member 38, the reflected light from the reflecting member 38 may also cross the conveyance path 49 and be incident on the a second reflecting member, and the reflected light from the second reflecting member may be incident on the light-receiving unit 34. In this manner, the number of times the light crosses the conveyance path 49 may be three. Increasing the number of reflecting members makes it possible to increase the number of times the light crosses the conveyance path 49. Thus the light crossing the conveyance path 49 may be any light that crosses the conveyance path 49 at least once between being output from the light-emitting unit 33 and being incident on the light-receiving unit 34. Additionally, the timing at which the light output from the light-emitting unit 33 crosses the conveyance path 49 may be before or after the light is incident on the reflecting member 38. In either case, the light-emitting unit 33 functions as a light-emitting unit that outputs light that crosses the conveyance path. Additionally, it is sufficient for at least one reflecting member 38 to be disposed between the light-emitting unit 33 and the light-receiving unit 34. The arrangement of the light-emitting unit 33 and the light-receiving unit 34 differs depending on the number of times the light crosses the conveyance path 49. If the light crosses the conveyance path 49 an even number of times, the light-emitting unit 33 and the light-receiving unit 34 are arranged on the same side as viewed from the conveyance path 49, as illustrated in FIG. 2A. However, if the light crosses the conveyance path 49 an odd number of times, the light-emitting unit 33 and the light-receiving unit 34 are arranged on opposite sides with the conveyance path 49 located therebetween.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-007885 filed Jan. 19, 2017, No. 2017-142001 filed Jul. 21, 2017, and No. 2017-231929 filed Dec. 1, 2017, which are hereby incorporated by reference herein in their entirety.

What is claimed is:

1. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a blower unit that sends air, the air being sent to the light-emitting unit;

a counting unit that counts an amount of time that has passed from when the blower unit starts blower operations;

a determination unit that determines whether or not the sheet is present on the basis of an amount of reflected light received by the light-receiving unit; and a light amount control unit that increases a light amount of the light-emitting unit from a first light amount to a second light amount when the amount of time that has passed reaches a predetermined amount of time.

2. The image forming apparatus according to claim 1, wherein the blower unit starts sending air to the light-emitting unit upon starting of image formation.

3. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a blower unit that sends air, the air being sent to the light-emitting unit;

a counting unit that counts an amount of time that has passed from when the blower unit has increased an airflow rate from a first airflow rate to a second airflow rate;

a determination unit that determines whether or not the sheet is present on the basis of an amount of reflected light received by the light-receiving unit; and a light amount control unit that increases a light amount of the light-emitting unit from a first light amount to a second light amount, wherein the light amount control unit increases the light amount of the light-emitting unit from the first light amount to the second light amount when the amount of time that has passed reaches a predetermined amount of time.

4. The image forming apparatus according to claim 3, wherein the first airflow rate is zero.

5. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a determination unit that determines whether or not the sheet is present on the basis of an amount of reflected light received by the light-receiving unit;

a gain control unit that increases a receiving gain of the light-receiving unit from a first gain to a second gain on the basis of a reflectance of the reflecting member;

a blower unit that sends air, the air being sent to the reflecting member; and a counting unit that counts an amount of time that has passed from when the blower unit starts blowing air, wherein the gain control unit reduces the receiving gain of the light-receiving unit from the second gain to the first gain upon the amount of time that has passed reaching a predetermined amount of time.

6. The image forming apparatus according to claim 5, wherein the blower unit starts sending air to the reflecting member unit upon starting of image formation.

7. The image forming apparatus according to claim 5, wherein the light-emitting unit, the light-receiving unit, and the reflecting member are disposed within or near the fixing unit.

8. The image forming apparatus according to claim 1, further comprising:

a temperature measurement unit that measures an ambient temperature of the reflecting member; and a deciding unit that decides the second light amount in accordance with the ambient temperature.

9. The image forming apparatus according to claim 8, wherein the temperature measurement unit measures the ambient temperature when the image forming apparatus starts forming an image.

10. The image forming apparatus according to claim 1, further comprising:

a ventilation duct that leads air blown from the blower unit or sucked by the blower unit to the light-emitting unit so as to cool the light-emitting unit.

11. The image forming apparatus according to claim 1, further comprising:

a first guide member and a second guide member, provided opposite each other in the conveyance path, that guide the sheet, wherein the light-emitting unit and the light-receiving unit are fixed to the first guide member, and the reflecting member is fixed to the second guide member.

12. The image forming apparatus according to claim 1, further comprising:

a light shielding member provided between the light-emitting unit and the light-receiving unit.

13. The image forming apparatus according to claim 12, wherein the light shielding member shields direct light directed from the light-emitting unit toward the light-receiving unit, and guides air from the blower unit or air traveling toward the blower unit to the reflecting member.

14. The image forming apparatus according to claim 1, wherein the light amount control unit furthermore increases the light amount of the light-emitting unit on the basis of an amount of light received by the light-receiving unit.

15. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a determination unit that determines whether or not the sheet is present on the basis of an amount of reflected light received by the light-receiving unit;

a gain control unit that increases a receiving gain of the light-receiving unit from a first gain to a second gain on the basis of a reflectance of the reflecting member;

a blower unit that supplies air to the reflecting member; and a counting unit that counts an amount of time that has passed from when the blower unit starts blowing air, wherein the gain control unit reduces the receiving gain of the light-receiving unit from the second gain to the first gain upon the amount of time that has passed reaching a predetermined amount of time.

16. The image forming apparatus according to claim 15, wherein the gain control unit increases the receiving gain of the light-receiving unit from the first gain to the second gain in a period from when condensation has formed on the reflecting member to when the amount of reflected light drops below a permissible limit.

17. The image forming apparatus according to claim 15, further comprising:

a ventilation duct that leads air blown from the blower unit or sucked by the blower unit to the reflecting member so as to blow on the reflecting member.

18. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a determination unit that determines whether or not the sheet is present on the basis of an amount of reflected light received by the light-receiving unit;

a gain control unit that increases a receiving gain of the light-receiving unit from a first gain to a second gain on the basis of a reflectance of the reflecting member;

a fixing unit that applies heat to a toner image transferred onto a sheet to fix the toner image onto the sheet;

a temperature measurement unit that measures a temperature of the fixing unit; and a deciding unit that decides a value of the second gain in accordance with the temperature.

19. The image forming apparatus according to claim 18, wherein the temperature measurement unit measures the temperature when the image forming apparatus starts forming an image.

20. The image forming apparatus according to claim 18, wherein the light-emitting unit, the light-receiving unit, and the reflecting member are disposed within or near the fixing unit.

21. The image forming apparatus according to claim 15, further comprising:

a temperature measurement unit that measures an ambient temperature of the reflecting member; and a deciding unit that decides the value of the second gain in accordance with the ambient temperature.

22. The image forming apparatus according to claim 21, wherein the temperature measurement unit measures the ambient temperature when the image forming apparatus starts forming an image.

23. The image forming apparatus according to claim 15, further comprising:

a first guide member and a second guide member, provided opposite each other in the conveyance path, that guide the sheet, wherein the light-emitting unit and the light-receiving unit are fixed to the first guide member; and the reflecting member is fixed to the second guide member.

24. The image forming apparatus according to claim 15, further comprising:

a light shielding member provided between the light-emitting unit and the light-receiving unit.

25. The image forming apparatus according to claim 15, further comprising:

a light amount control unit that controls a light amount of the light-emitting unit, wherein the light amount control unit increases the light amount of the light-emitting unit from a first light amount to a second light amount at any timing in a period from when condensation begins to form on the reflecting member to when the amount of reflected light received by the light-receiving unit drops below a permissible limit.

26. The image forming apparatus according to claim 15, further comprising:

a condensation detection unit that detects condensation on the reflecting member, wherein a period from when condensation begins to form on the reflecting member to when the amount of reflected light received by the light-receiving unit drops below the permissible limit is decided on the basis of a detection result from the condensation detection unit.

27. The image forming apparatus according to claim 15, wherein the light-receiving unit includes:

a light-receiving element; and a variable resistor connected between the light-receiving element and the determination unit, and the gain control unit controls the receiving gain by changing a resistance of the variable resistor.

28. The image forming apparatus according to claim 27, wherein the variable resistor includes:

at least two resistors connected in parallel; and a switching element connected in series to at least one of the resistors of the at least two resistors, and the gain control unit controls the receiving gain by controlling the switching element and changing a combined resistance value of the at least two resistors.

29. The image forming apparatus according to claim 15, wherein the gain control unit furthermore increases the receiving gain of the light-receiving unit on the basis of an amount of light received by the light-receiving unit.

30. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a blower unit that sends air, the air being sent to the light-emitting unit; and a determination unit that determines whether or not the sheet is present on the basis of an amount of reflected light received by the light-receiving unit, wherein upon starting of image formation, the blower unit starts sending air and an amount of light emitted from the light emitting unit is increased from a first light amount to a second light amount.

31. An image forming apparatus comprising:

a light-emitting unit that emits light such that the light crosses a conveyance path along which a sheet is conveyed;

a reflecting member, provided opposite the light-emitting unit, that reflects the light;

a light-receiving unit that receives reflected light from the reflecting member;

a blower unit that sends air, the air being sent to the reflecting member; and a determination unit that determines whether or not the sheet is present on the basis of an amount of reflected light received by the light-receiving unit, wherein upon starting of image formation, a gain of the light receiving unit is increased from a first light amount to a second light amount.

* * * * *